US009738089B2

(12) United States Patent
Suzuki

(10) Patent No.: US 9,738,089 B2
(45) Date of Patent: Aug. 22, 2017

(54) LIQUID EJECTION APPARATUS PROVIDED WITH NOZZLES LOCATED AT DIFFERENT POSITIONS IN CONVEYING DIRECTION

(71) Applicant: Brother Kogyo Kabushiki Kaisha, Nagoya-shi, Aichi-ken (JP)

(72) Inventor: Katsuaki Suzuki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/071,770

(22) Filed: Mar. 16, 2016

(65) Prior Publication Data

US 2016/0271937 A1 Sep. 22, 2016

(30) Foreign Application Priority Data

Mar. 17, 2015 (JP) ..... 2015-053292

(51) Int. Cl.
*B41J 2/21* (2006.01)

(52) U.S. Cl.
CPC ..... *B41J 2/2146* (2013.01); *B41J 2/2135* (2013.01)

(58) Field of Classification Search
CPC ..... B41J 2/2146; B41J 2/2135
See application file for complete search history.

(56) References Cited

U.S. PATENT DOCUMENTS

2007/0206040 A1* 9/2007 Furuya ..... B41J 2/04573 347/15
2009/0189935 A1 7/2009 Kunimatsu
2013/0328957 A1 12/2013 Teshigawara et al.
2015/0273896 A1* 10/2015 Koizumi ..... B41J 3/60 347/10
2016/0096363 A1* 4/2016 Kawatoko ..... B41J 2/155 347/12
2016/0243858 A1* 8/2016 Ogimura ..... B41J 13/0009

FOREIGN PATENT DOCUMENTS

JP 2009-196349 A 9/2009
JP 2013-184458 A 9/2013
JP 2013-252641 A 12/2013
JP 2014-104679 A 6/2014

* cited by examiner

*Primary Examiner* — Justin Seo
(74) *Attorney, Agent, or Firm* — Banner & Witcoff, Ltd.

(57) ABSTRACT

A liquid ejection apparatus corrects image data by: setting a to-be-corrected dot element; acquiring a correction amount based on an offset between a formation position at which a dot corresponding to the to-be-corrected dot element is to be formed on a recording medium while the recording medium is conveyed the reference conveyance amount per unit time and a formation position at which a dot corresponding to the to-be-corrected dot element is to be formed while the recording medium is conveyed a conveyance amount different from the reference conveyance amount per unit time; and executing correction on the to-be-corrected dot element. The correction is executed by setting a density value for the to-be-corrected dot element as that for corresponding one dot element whose data array order is shifted from a data array order of the to-be-corrected dot element by the number of dot elements corresponding to the correction amount.

7 Claims, 12 Drawing Sheets

| | NOZZLE ROW | | | | | | | | | | | | | | | |
|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 |
| NUMBER OF DOT ELEMENTS FOR CORRECTION | 0 | 4 | 2 | 3 | 1 | 4 | 1 | 3 | 0 | 4 | 2 | 3 | 0 | 3 | 1 | 2 |

LIQUID EJECTION APPARATUS PROVIDED WITH NOZZLES LOCATED AT DIFFERENT POSITIONS IN CONVEYING DIRECTION

CROSS REFERENCE TO RELATED APPLICATION

This application claims priority from Japanese Patent Application No. 2015-053292 filed Mar. 17, 2015. The entire content of the priority application is incorporated herein by reference.

TECHNICAL FIELD

The present disclosure relates to a liquid ejection apparatus.

BACKGROUND

A conventional line-type inkjet recording apparatus includes a plurality of conveying roller pairs for conveying a recording medium in a conveying direction, and a plurality of recording heads for ejecting inks of different colors. In the line-type inkjet recording apparatus, the plurality of recording heads is arranged in the conveying direction at predetermined intervals. In this type of line-type inkjet recording apparatus, recording positions in a recording medium for the recording heads may be shifted when a conveyance amount per unit time of the recording medium varies due to a change in a surface of a conveying roller.

The conventional inkjet recording apparatus obtains, for each of the plurality of recording heads, a deviation amount (an offset) of a recording position in the recording medium with respect to a recording position of the reference recording head and adds non-image data to respective recording data of the plurality of recording heads on the basis of the respective deviation amounts, to correct the deviation in the recording medium between the recording positions of the recording heads.

SUMMARY

Incidentally, there is a known inkjet recording apparatus including one recording head in which a plurality of nozzles is arranged in a direction orthogonal to the conveying direction and constitutes of a plurality of nozzle arrays arranged in the conveying direction. In this type of inkjet recording apparatus, ink ejection timing when a dot line is formed in the direction orthogonal to the conveying direction on the recording medium is different for each nozzle array. For this reason, deviation amount of recording positions in the recording medium are different for each nozzle array when a conveyance amount per unit time of the recording medium varies. Here, when the inkjet recording apparatus described above includes one recording head in which a plurality of nozzles are configured so as to form a plurality of nozzle arrays, the inkjet recording apparatus cannot correct the deviation of the recording positions in the conveying direction on the recording medium between nozzle arrays included in the one recording head. In particular, such a deviation of recording positions in the conveying direction may cause noticeable reduction in image quality when the inkjet recording apparatus described above records a line image such as a ruled line or a bar code on the recording medium.

When the conveyance amount per unit time of the recording medium varies, the relative recording positions between the nozzle arrays can be adjusted by adjusting ejection timings of the nozzle arrays on the basis of the variation of the conveyance amount. However, in this case, a circuit structure of a driving device for ejecting ink droplets needs to be complicated to adjust the ejection timing, and thus a problem of increase in cost arises.

It is therefore an object of the disclosure to provide a liquid ejection apparatus capable of correcting deviations of recording positions in a conveying direction on a recording medium between nozzle arrays included in one recording head using a simple configuration.

In order to attain the above and other objects, the disclosure provides a liquid ejection apparatus including a conveying mechanism, a liquid ejection head, and a controller. The conveying mechanism is configured to convey a recording medium in a conveying direction. The liquid ejection head has an ejection surface on which a plurality of nozzle arrays is arranged in the conveying direction. Each of the plurality of nozzle arrays has a plurality of nozzles arranged in a direction perpendicular to the conveying direction. Each of the plurality of nozzles is used for ejecting a liquid droplet on the recording medium conveyed by the conveying mechanism. A conveyance section is defined between a position at which a leading end of the recording medium reaches an ejection region and a position at which a trailing end of the recording medium has passed through the ejection region. The ejection region is a region in which at least part of the recoding medium faces at least one nozzle on the ejection surface. The conveyance section is divided into a first divisional section in which the recording medium is conveyed a first conveyance amount per unit time and a second divisional section in which the recording medium is conveyed a second conveyance amount per unit time. The controller is configured to: correct image data to generate corrected image data, the image data including a plurality of dot data rows, each of the plurality of dot rows having a plurality of dot elements that is arranged in a data array direction, the plurality of dot elements corresponding to a plurality of dots to be formed and arranged in the conveying direction on the recording medium, the plurality of dot elements and the plurality of dots having a one-to-one correspondence, an order of each of the dot elements in the data array direction being the same as an order of corresponding one dot of the plurality of dots to be formed on the recording medium in the conveying direction, a density value being set for each of the plurality of dot elements; and control the liquid ejection head to record dots on the recording medium on a basis of the corrected image data such that liquid droplets are ejected from nozzles of the liquid ejection head on an assumption that the recording medium is conveyed a predetermined conveyance amount per unit time during a period of time in which the recording medium is conveyed within a conveyance section, the predetermined conveyance amount being equal to the first conveyance amount. The controller is configured to generate the corrected image data by: setting, as a to-be-corrected dot element, a dot element corresponding to a dot to be formed on the recording medium during a period of time in which the recording medium is conveyed in the second divisional section, from among the plurality of dot elements included in each of the plurality of dot data rows; acquiring a correction amount for the to-be-corrected dot element, the correction amount being based on an offset in the conveying direction between: a formation position at which a dot corresponding to the to-be-corrected dot element is to be formed on the recording medium during the period of time in which the recording medium is conveyed the second conveyance amount per unit time; and a formation position at which a dot corresponding to the to-be-corrected dot element is to be formed on the recording medium during the period of time in which the recording medium is conveyed the reference conveyance amount per unit time; and executing correction on the to-be-corrected dot element by setting the density value that is set for the to-be-corrected dot element as a density value for corresponding one dot element in the corrected image data, an order in the data array direction of the corresponding one dot element of the corrected image data being shifted from an order in the data array direction of the to-be-corrected dot element of the image data by a number of dot elements corresponding to the correction amount.

According to another aspect, the present disclosure provides a liquid ejection apparatus including a conveying mechanism, a liquid ejection head, and a controller. The conveying mechanism is configured to convey a recording medium in a conveying direction. The liquid ejection head has an ejection surface on which a plurality of nozzle arrays is arranged in the conveying direction. Each of the plurality of nozzle arrays has a plurality of nozzles arranged in a direction perpendicular to the conveying direction. Each of the plurality of nozzles is used for ejecting a liquid droplet on the recording medium conveyed by the conveying mechanism. A conveyance section is defined between a position at which a leading end of the recording medium reaches an ejection region and a position at which a trailing end of the recording medium has passed through the ejection region. The ejection region is a region in which at least part of the recoding medium faces at least one nozzle on the ejection surface. The conveyance section is divided into a first divisional section in which the recording medium is conveyed a first conveyance amount per unit time and a second divisional section in which the recording medium is conveyed a second conveyance amount per unit time. The controller configured to: correct image data to generate corrected image data, the image data including a plurality of dot data rows, each of the plurality of dot rows having a plurality of dot elements that is arranged in a data array direction, the plurality of dot elements corresponding to a plurality of dots to be formed and arranged in the conveying direction on the recording medium, the plurality of dot elements and the plurality of dots having a one-to-one correspondence, an order of each of the dot elements in the data array direction being the same as an order of corresponding one dot of the plurality of dots to be formed on the recording medium in the conveying direction, a density value being set for each of the plurality of dot elements; and control the liquid ejection head to record dots on the recording medium on a basis of the corrected image data such that liquid droplets are ejected from nozzles of the liquid ejection head on an assumption that the recording medium is conveyed a predetermined conveyance amount per unit time during a period of time in which the recording medium is conveyed within a conveyance section, the predetermined conveyance amount being equal to the first conveyance amount. The controller is configured to generate the corrected image data by: setting, as one reference dot data row, one of the plurality of dot data row corresponding to the nozzle of a reference nozzle array, the reference nozzle array being one of the plurality of nozzle arrays; setting, as a to-be-corrected dot data row, each of remaining dot data row of the plurality of dot data rows other than the one reference dot row; setting, as a to-be-corrected dot element, a dot element corresponding to a dot to be formed on the recording medium during a period of time in which the recording medium is conveyed in the second divisional section, from among the plurality of dot elements included in each to-be-corrected dot data row; acquiring a correction amount for the to-be-corrected dot element, the correction amount being based on an offset in the conveying direction between: a formation position at which a dot corresponding to the to-be-corrected dot element is to be formed on the recording medium; and a formation position at which a dot corresponding to one reference dot element in the one reference dot row is to be formed on the recording medium, an order in the data array direction of the reference one dot element of the one reference dot data row being the same as an order in the data array direction of the to-be-corrected dot element of the each to-be-corrected dot data row; and executing correction on the to-be-corrected dot element by setting the density value that is set for the to-be-corrected dot element as a density value for corresponding one dot element in the corrected image data, an order in the data array direction of the corresponding one dot element of the corrected image data being shifted from an order in the data array direction of the to-be-corrected dot element of the image data by a number of dot elements corresponding to the correction amount.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
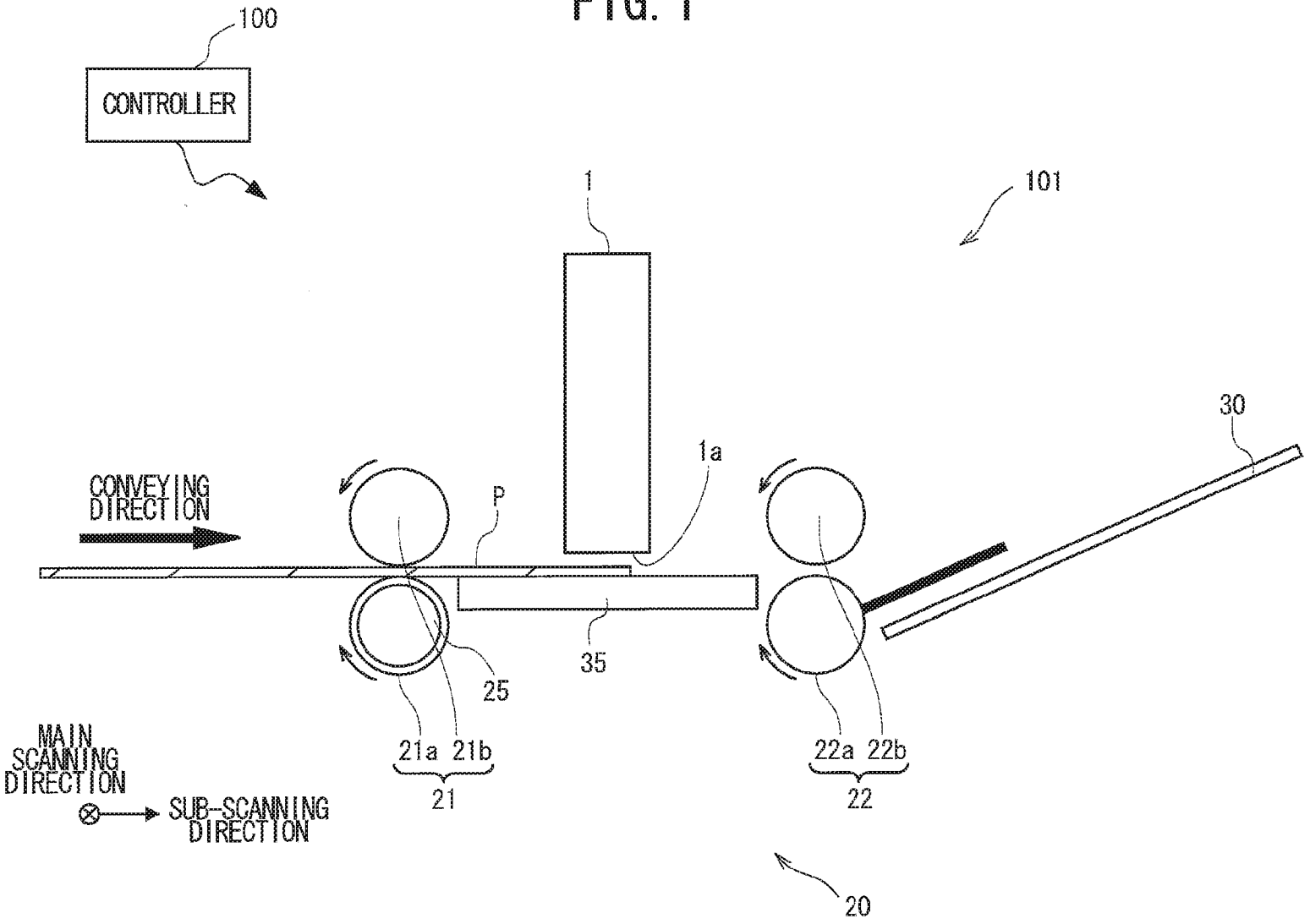
FIG. 1 is a schematic side view of an inkjet printer according to an embodiment.

Hereinafter, an inkjet printer will be described with reference to drawings as an example of a liquid ejection apparatus according to an embodiment. As illustrated in FIG. 1, an inkjet printer 101 includes an inkjet head 1 (serving as an example of a liquid ejection head), a conveying mechanism 20, a paper tray 30, a platen 35, and a controller 100.

Figure 2A:
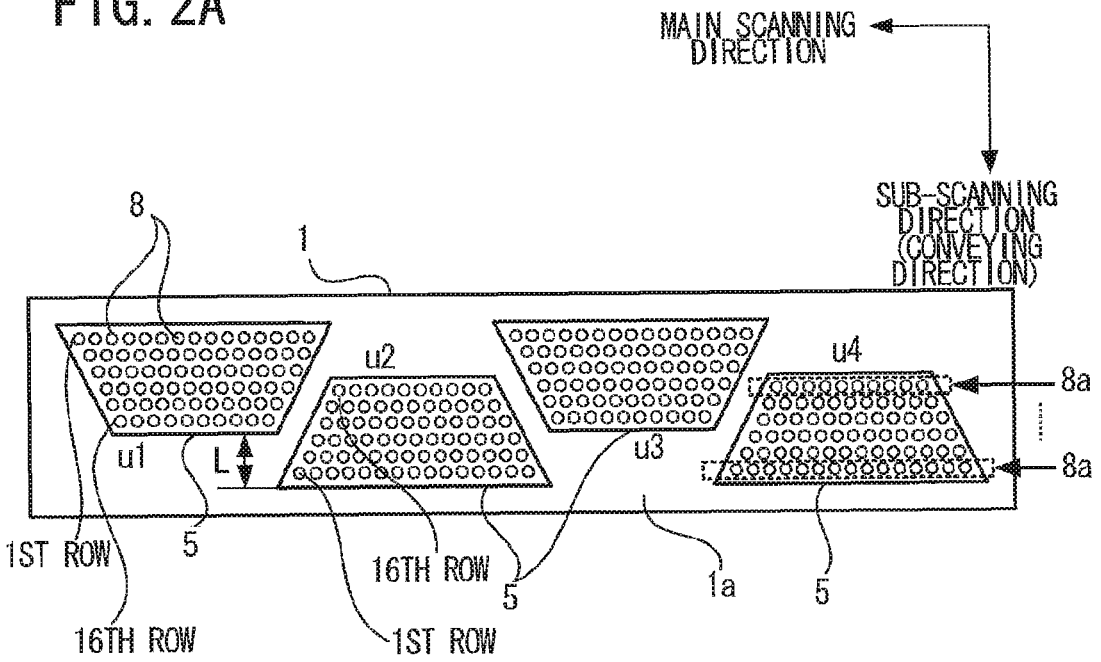
FIG. 2A is a top view of an inkjet head of the inkjet printer shown in FIG. 1.

As illustrated in FIGS. 1 and 2A, the inkjet head 1 (hereinafter, head 1) has a substantially cuboid shape and includes an ejection surface 1*a* on a lower surface thereof. A plurality of nozzles 8 for ejecting ink droplets is formed on the ejection surface 1*a*. Ink is supplied to the head 1 from an ink tank (not illustrated). The ink supplied to the head 1 reaches the plurality of nozzles 8 via a common ink chamber and a plurality of pressure chambers that communicates with the common ink chamber. When an actuator (described below) included in an actuator unit 5*a* (see FIG. 3) described below is driven, pressure is applied to ink accumulated in the pressure chambers and ink droplets are ejected from the plurality of nozzles 8. Even though FIG. 2A is a top view of the head 1, the plurality of nozzles 8 are indicated by solid lines for convenience of description.

Figure 2B:
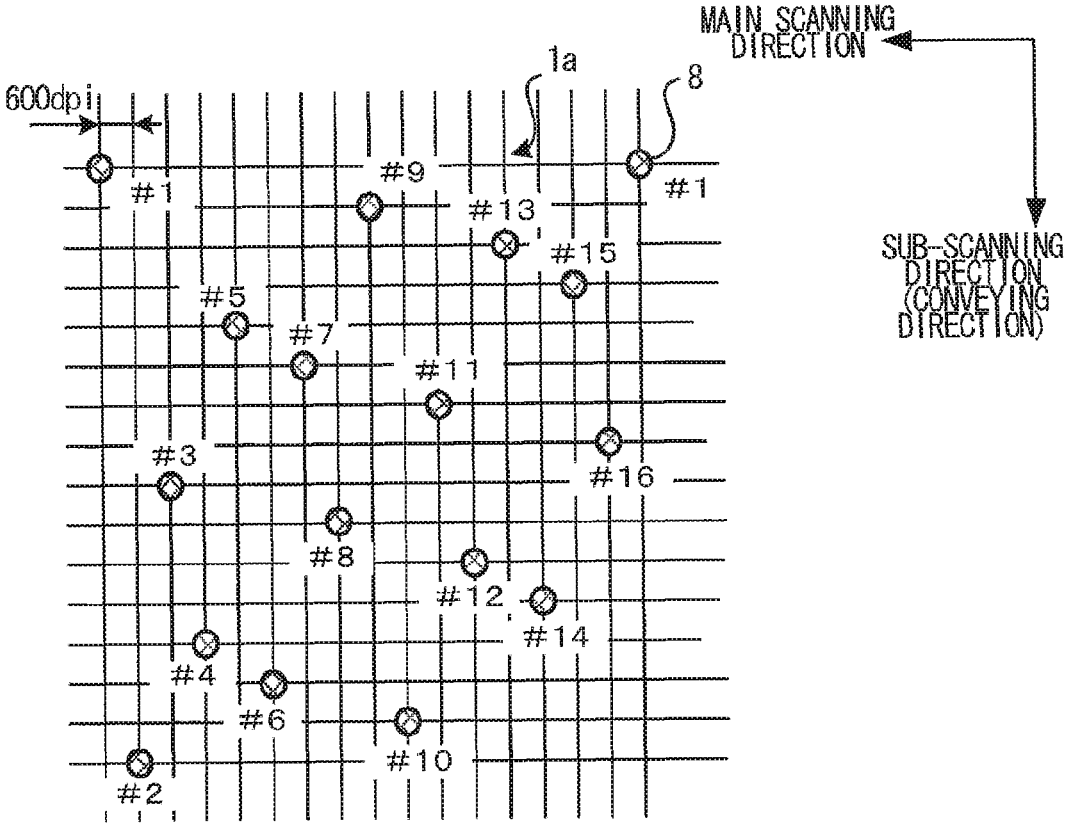
FIG. 2B is a partial enlarged view of the inkjet head shown in FIG. 2A.

As illustrated in FIG. 2A, the plurality of nozzles 8 constitutes of four nozzles units 5 (u1 to u4 from a left side to a right side in order in FIG. 2A). The nozzle units 5 include sections having shapes of trapezoids in which the nozzles 8 are disposed in matrix forms and disposed at difference positions in a main scanning direction. The nozzle units u1 and u2 are disposed at different positions and shifted by L in a sub-scanning direction. Further, the nozzle units u3 and u4 are disposed at different positions and shifted by L in the sub-scanning direction. The nozzles 8 included in each of the nozzle units 5 are arranged in a matrix form in the main scanning direction and the sub-scanning direction. Specifically, as illustrated in FIG. 2B, these nozzles 8 are disposed on any one of sixteen virtual lines extending in parallel to one another along the main scanning direction. That is, the nozzles 8 disposed in the main scanning direction forms one nozzle array 8*a*, and sixteen nozzle arrays 8*a* (nozzle arrays #1 to #16) are disposed in parallel to one another and in the sub-scanning direction in the each nozzle unit 5. FIG. 2A schematically illustrates only six nozzle arrays 8*a*. Here, the sub-scanning direction is a direction parallel to the conveying direction in which paper P is conveyed by the conveying mechanism 20, and the main scanning direction is a direction orthogonal to the sub-scanning direction (and perpendicular to the conveying direction) and along a horizontal plane.

Two adjacent nozzles 8 positioned on the respective virtual lines are arranged at equal intervals. Further, sixteen nozzles 8 disposed on different virtual lines are arranged within a width of 600 dpi (about 42 μm)×15 without overlapping each other in the main scanning direction. These sixteen nozzles 8 form a base unit for recording an image at 600 dpi corresponding to a highest resolution in the main scanning direction. In each nozzle unit 5, a plurality of base units is continuously arranged in the main scanning direction.

All the nozzles 8 included in the four nozzle units 5 (that is, all nozzles 8 formed on the head 1) have a positional relation in which all projective points of the nozzles 8 are arranged at equal intervals corresponding to a resolution of 600 dpi when the nozzles 8 are vertically projected on an arbitrary virtual line extending in the main scanning direction. For this reason, the plurality of dot lines corresponds to the plurality of nozzles 8, respectively. Each of the plurality of dot lines consists of a plurality of dots (including a non-ejected dot on which an ink droplet is not ejected) formed by the same nozzle 8 and arranged in respective direction along the conveying direction.

The four nozzle units 5 are disposed in a zigzag shape in the main scanning direction such that long sides and short sides are inverted in order with respect to the sub-scanning direction. Specifically, the nozzle unit u1 and the nozzle unit u3 are disposed at positions that are the same in the sub-scanning direction and are different from each other in the main scanning direction. The nozzle unit u2 and the nozzle unit u4 are disposed at positions that are the same in the sub-scanning direction and are different from each other in the main scanning direction. Therefore, the head 1 of the embodiment includes thirty-two nozzle arrays 8*a* in total including: sixteen nozzle arrays 8*a* (nozzle arrays #1 to #16) of the nozzle unit u1 and the nozzle unit u3; and sixteen nozzle arrays 8*a* (nozzle arrays #17 to #32) of the nozzle unit u2 and the nozzle unit u4.

One actuator unit 5*a* (see FIG. 3) is used for each of the nozzle units 5. The actuator unit 5*a* includes actuators, the number of which corresponds to the number of nozzles 8 included in each nozzle unit 5. Driver ICs 5*b* (see FIG. 3) are provided for the actuator units 5*a*, respectively. Each driver IC 5*b* is configured to control the corresponding actuator unit 5*a*.

Each driver IC 5*b* receives a waveform selection signal and a plurality of driving waveform signals from the controller 100. The plurality of driving waveform signals has different waveforms. The waveform selection signal indicates one of the plurality of driving waveform signals. Four types of driving waveform signals are used in the embodiment. Four types of driving waveform signals correspond to four types of ink droplets that can be ejected from each nozzle 8 of the head 1, specifically, large droplet, middle droplet, small droplet, and non-ejection.

Each driver IC 5*b* successively receives the waveform selection signal from the controller 100, and supplies, as a driving pulse signal, one of the plurality of driving waveform signals indicated by the waveform selection signal to an actuator of the actuator unit 5*a* for each ejection period. When the driving pulse signal is supplied to the actuator, an ink droplet whose amount corresponds to the waveform of the driving pulse signal is ejected from a nozzle 8 corresponding to the actuator.

Returning to FIG. 1, the conveying mechanism 20 is configured to convey the paper P in the conveying direction from a left side toward a right side of FIG. 1, and includes a first conveying unit 21 and a second conveying unit 22. The first conveying unit 21 and the second conveying unit 22 are disposed to interpose the head 1 therebetween in the conveying direction of the paper P.

The first conveying unit 21 includes a pair of conveying rollers 21*a* and 21*b* and a first motor 21*c* (see FIG. 3) configured to drive the conveying rollers 21*a* and 21*b* to rotate. The conveying rollers 21*a* and 21*b* are rotated in different directions (see arrows of FIG. 1) by the first motor 21*c* to convey the paper P supplied from a paper feeding unit (not illustrated) in the conveying direction while pinching the paper P therebetween.

A rotary encoder 25 (FIG. 3) is provided on a rotating shaft of the conveying roller 21*a*. The rotary encoder 25 outputs a pulse signal corresponding to rotation of the conveying roller 21*a* to the controller 100. In the embodiment, the rotary encoder 25 is set such that one period worth of pulse signal is transmitted each time the conveying roller 21*a* rotates a prescribed amount. The prescribed amount is a rotation amount that the first conveying unit 21 should rotate in order to convey the paper P a prescribed distance corresponding to the resolution in the sub-scanning direction of an image to be recorded on the paper P. Then, an operation of ejecting ink droplets from the head 1 is synchronized with a pulse period output by the rotary encoder 25. The conveying roller 21*a* is rotated by the first motor 21*c* even when the first conveying unit 21 does not convey the paper P by sandwiching the paper P therein, and the rotary encoder 25 outputs the pulse signal corresponding to the rotation of the conveying roller 21*a* to the controller 100.

The second conveying unit 22 includes a pair of conveying rollers 22*a* and 22*b* having the same diameters as those of the conveying rollers 21*a* and 21*b*, and a second motor 22*c* (see FIG. 3) configured to drive the conveying rollers 22*a* and 22*b* to rotate. When the conveying rollers 22*a* and 22*b* are rotated in different directions (see arrows of FIG. 1) by the second motor 22*c*, the conveying rollers 22*a* and 22*b* receive the paper P which is being conveyed by the first conveying unit 21 and further convey the paper P in the conveying direction while sandwiching the paper therebetween.

Here, a conveyance speed V1 at which the paper P is conveyed by the first conveying unit 21 may be different from a conveyance speed V2 at which the paper P is conveyed by the second conveying unit 22. Examples of a reason for the different conveyance speeds include: a case in which the first conveying unit 21 and the second conveying unit 22 are set in advance such that the conveyance speed V1 and the conveyance speed V2 are different from each other; and a case in which the conveyance speeds V1 and V2 are shifted from the designed conveyance speed of the paper P due to a manufacturing error or an assembly error even when the designed conveyance speeds of the first conveying unit 21 and the second conveying unit 22 are set to the same speeds.

Examples of a design reason for making the conveyance speed V1 and the conveyance speed V2 different from each other include improvement in quality of an image recorded on the paper P. For example, in the case that the conveyance speed V2 is set to a speed faster than the conveyance speed V1, a certain tension can be applied to the paper P when the paper P is delivered to the second conveying unit 22 from the first conveying unit 21. This configuration can prevent the paper P from bending while an image is recorded on the paper P, and thus can improve the quality of the image recorded on the paper P.

For example, the conveying force may be mainly applied from the first conveying unit 21 to the paper P while the ink ejection operation is performed in synchronization with the rotary encoder 25 attached to the first conveying unit 21 as in the embodiment, even when the paper P is conveyed by both the first conveying unit 21 and the second conveying unit 22. This configuration can improve quality of an image recorded on the paper P. When the conveyance speed V1 at which the paper P is conveyed by the first conveying unit 21 is faster than the conveyance speed V2 at which the paper P is conveyed by the second conveying unit 22, the conveying force of the first conveying unit 21 is greater than that of the second conveying unit 22, and thus quality of the image recorded on the paper P can be improved. In this case, it is preferable that a force at which the paper P is sandwiched between the conveying rollers 22*a* and 22*b* of the second conveying unit 22 be smaller than a force at which the paper P is sandwiched between the conveying rollers 21*a* and 21*b* of the first conveying unit 21. Hereinafter, a description will be given on the assumption that the conveyance speed V1 at which the paper P is conveyed by the first conveying unit 21 is higher than the conveyance speed V2 at which the paper P is conveyed by the second conveying unit 22, and the force at which the paper P is sandwiched between the conveying rollers 22*a* and 22*b* of the second conveying unit 22 is smaller than the force at which the paper P is sandwiched between the conveying rollers 21*a* and 21*b* of the first conveying unit 21.

The platen 35 is disposed to face the ejection surface 1*a* of the head 1, and configured to support the paper P being conveyed by the conveying mechanism 20 from below. When the paper P is supported on the platen 35, the predetermined gap suitable for image recording is formed between an upper surface of the platen 35 and the ejection surface 1*a* of the head 1.

In the above configuration, an image is recorded with dots formed on the paper P by ejecting ink droplets from the nozzles 8 formed on the ejection surface 1*a* of the head 1 while the paper P is conveyed by the conveying mechanism 20, during a period of time from when the paper P reaches an ejection region until the paper P is passed through the ejection region. The ejection region corresponds to an area on the platen 35 facing the ejection surface 1*a*. That is, the ejection region corresponds to a range in which dots can be formed on the paper P by ink droplets ejected from the head 1. The paper P on which the image has been recorded is further conveyed by the conveying mechanism 20 and is discharged to the paper tray 30.

Figure 3:
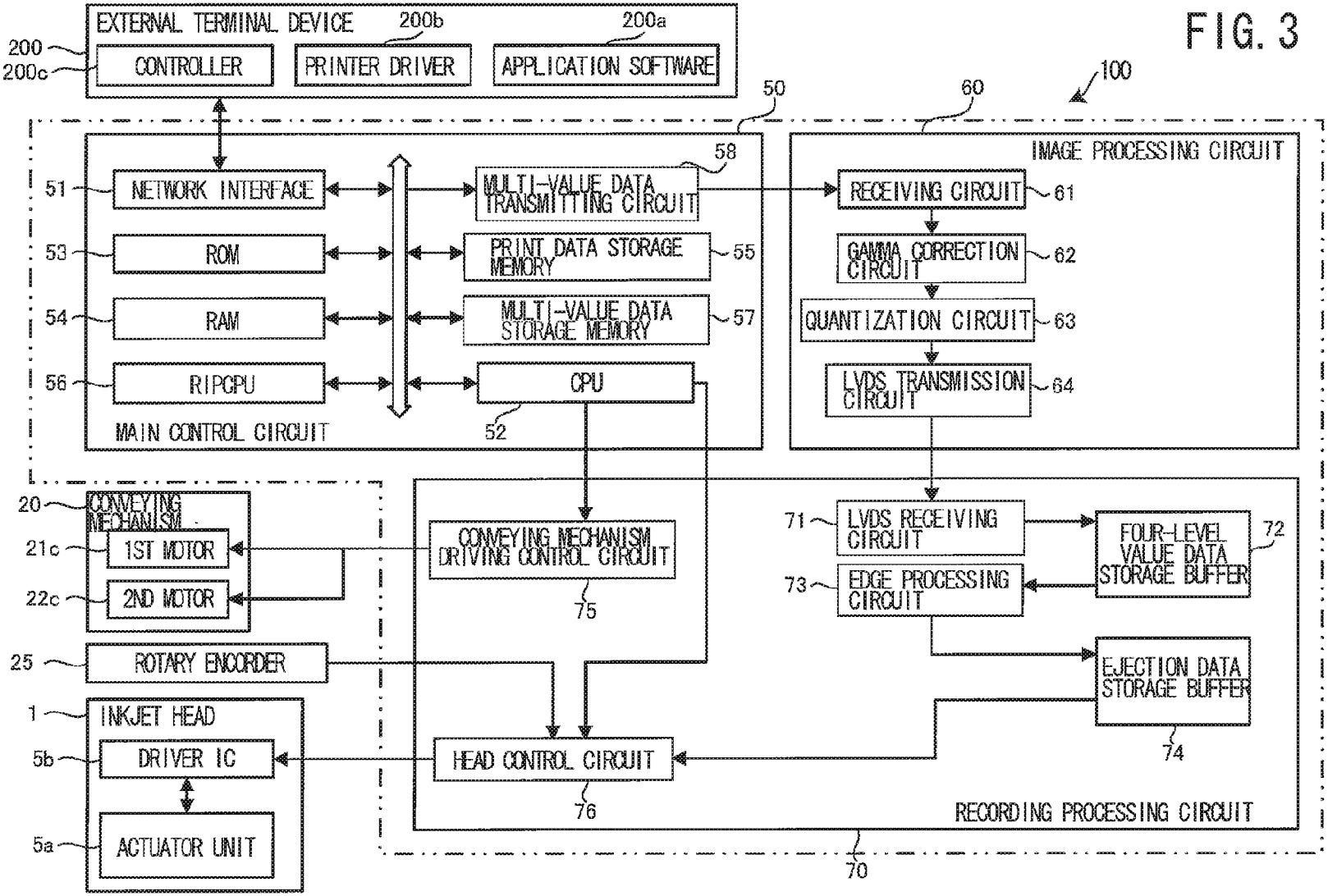
FIG. 3 is a block diagram illustrating the electrical confirmation of the inkjet printer shown in FIG. 1.

Next, the controller 100 will be described with reference to FIG. 3. The controller 100 includes a main control circuit 50 that manages overall operation of the inkjet printer 101, an image processing circuit 60 that performs image processing, and a recording processing circuit 70 that controls the head 1 and the conveying mechanism 20.

The main control circuit 50 includes a network interface 51, a central processing unit (CPU) 52, a read only memory (ROM) 53, a random access memory (RAM) 54, a print data storage memory 55, a raster image processing CPU (RIPCPU) 56, a multi-value data storage memory 57, and a multi-value data transmitting circuit 58.

The network interface 51 is connected to an external terminal device 200 such as a personal computer (PC) through a local area network (LAN). The external terminal device 200 stores application software 200*a* capable of writing data for printing, and a printer driver 200*b* for setting a processing condition of the inkjet printer 101. The external terminal device 200 includes a controller 200*c* configured to activate the printer driver 200*b* to convert data written by the application software 200*a* into print data described in a page description language (PDL). The controller 200*c* is configured to transmit the converted print data to the inkjet printer 101.

Various programs executed by the CPU 52 or the RIPCPU 56 are stored in the ROM 53. The RAM 54 is used as a working area of the CPU 52 and the RIPCPU 56. The print data storage memory 55 stores the print data received from the external terminal device 200 through the network interface 51.

The RIPCPU 56 generates multi-value image data (hereinafter, multi-value data) by performing known RIP (raster image processing) on the print data stored in the print data storage memory 55 according to an instruction from the CPU 52.

Figure 4A:
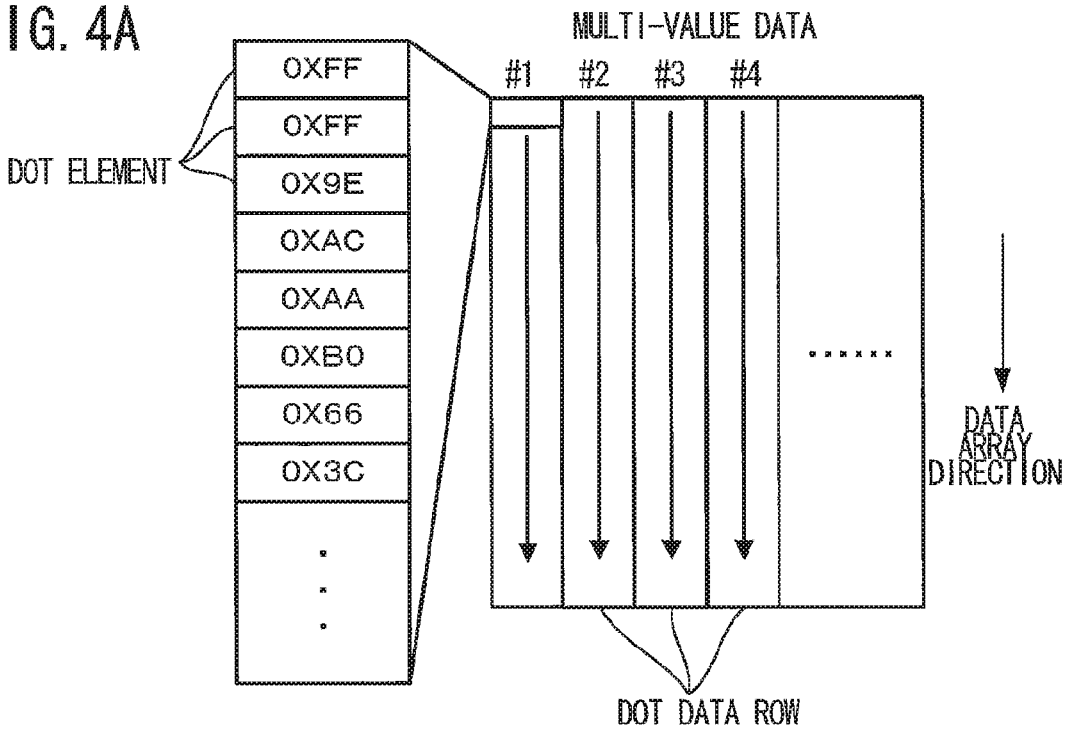
FIG. 4A is an explanatory diagram illustrating multi-value data.

As illustrated in FIG. 4A, the multi-value data is image data corresponding to a dot formation area on the paper P in which dots can be formed by ink droplets ejected from the nozzles 8 of the head 1. Each nozzle 8 is configured to form a plurality of dots that are arranged in the conveying direction on the paper P. The multi-value data includes a plurality of dot data rows corresponding to the plurality of nozzles 8 formed on the head 1, respectively. Each dot data row includes a plurality of dot elements corresponding to the plurality of dots to be formed and arranged in the conveying direction on the paper P, respectively. The plurality of dot elements included in each dot data row is arranged in an order according to a sequence of the plurality of dots that is arranged in the conveying direction, and is formed by the corresponding one nozzle 8. Each of the plurality of dot data rows corresponds to any one of the plurality of nozzles 8 formed on the head 1. A density value is set for each dot element of the multi-value data, and is expressed by M gradations (M is an integer greater than or equal to 3). In this embodiment, the multi-value data is 256-gradation data in which a density value for each dot element is expressed by 256 gradations.

The RIPCPU 56 performs correction processing to correct the multi-value data generated through RIP, and stores the corrected multi-value data in the multi-value data storage memory 57. The correction processing will be described in detail below.

The multi-value data transmitting circuit 58 transmits the multi-value data stored in the multi-value data storage memory 57 to the image processing circuit 60 according to an instruction from the CPU 52.

The image processing circuit 60 is a circuit configured to perform image processing on the multi-value data received from the main control circuit 50. The image processing circuit 60 includes a receiving circuit 61, a gamma correction circuit 62, a quantization circuit 63, and a low voltage differential signaling (LVDS) transmitting circuit 64.

The receiving circuit 61 receives the multi-value data transmitted from the main control circuit 50. The gamma correction circuit 62 is a circuit configured to perform gamma correction on the multi-value data received by the receiving circuit 61. The gamma correction is a process for correcting or adjusting densities in an image. In the embodiment, the multi-value data is converted into high-gradation data through the gamma correction. Specifically, a density value of 256 gradations for each dot element included in the multi-value data is converted into a density value of 1024 gradations. In this way, the gamma correction on the multi-value data can provide performing more accurately density control such as error diffusion processing described below.

The quantization circuit 63 performs the error diffusion processing for quantizing the multi-value data corrected by the gamma correction circuit 62 to N-level value data of a low gradation (N is an integer greater than or equal to 2 and less than M). The error diffusion processing is image processing in which an error of each dot element is distributed to a neighboring dot element by reducing a gradation level of data from M to N. As an example of modification, the N-level value data may be generated from the multi-value data by executing known dither processing.

Figure 4B:
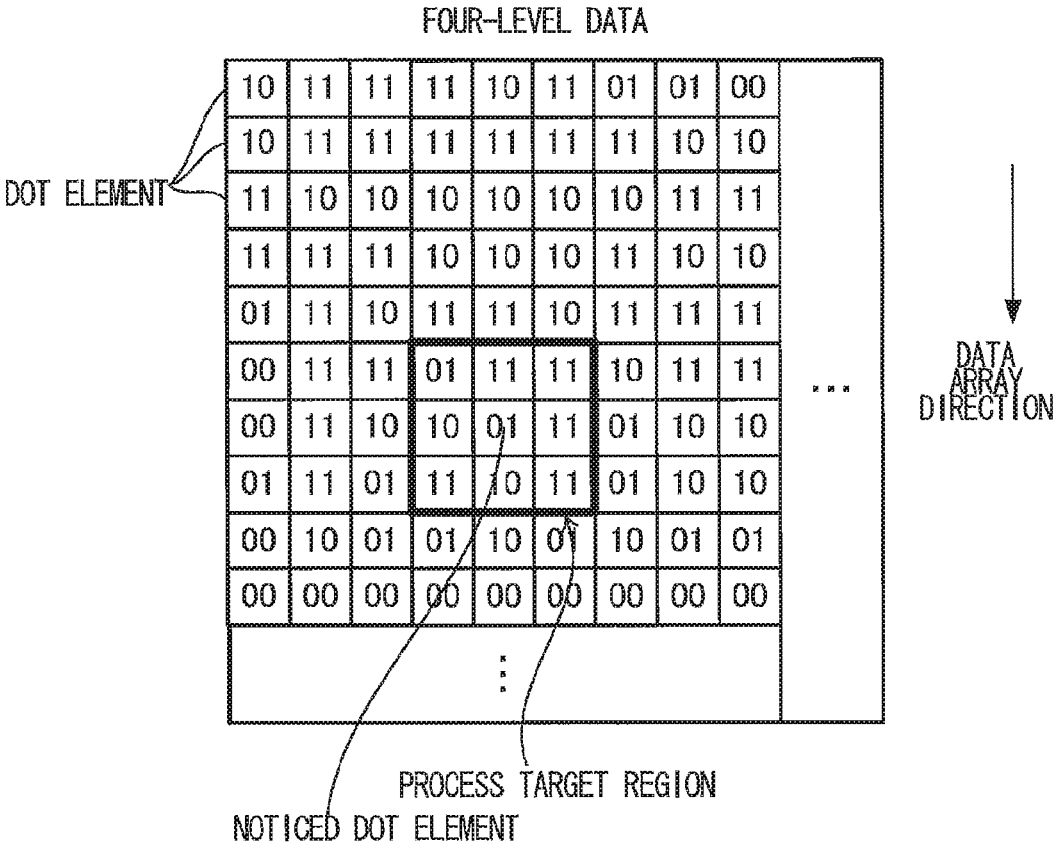
FIG. 4B is an explanatory diagram illustrating four-level data.

In this way, the N-level value data generated by the quantization circuit 63 includes density values of respective dot elements, each density value being expressed by N gradations. In this embodiment, the N-level value data generated based on the multi-value data by the quantization circuit 63 is four-level density data as shown in FIG. 4B. That is, N is four in this embodiment. Specifically, a density value expressed by four gradations is set for each dot element in the N-level value data. Four-level density values that can be set for each dot element in the four-level value data include: a value of "00" corresponding to non-ejection, a value of "01" corresponding to a small size of ink droplet, a value of "10" corresponding to a middle size of ink droplet, and a value of "11" corresponding to a large size of ink droplets.

The LVDS transmitting circuit 64 is configured to convert the four-level value data generated by the quantization circuit 63 into a differential signal and to transmit the differential signal to the recording processing circuit 70 using the LVDS.

The recording processing circuit 70 is configured to perform image recording processing for recording an image on the paper P on the basis of the four-level value data received from the image processing circuit 60. The recording processing circuit 70 includes an LVDS receiving circuit 71, a four-level value data storage buffer 72, an edge processing circuit 73, an ejection data storage buffer 74, a mechanical system driving control circuit 75, and a head control circuit 76.

The LVDS receiving circuit 71 is a LVDS receiver configured to receive the differential signal transmitted from the image processing circuit 60 and to restore the differential signal to the four-level value data. The four-level value data received by the LVDS receiving circuit 71 is stored in the four-level value data storage buffer 72.

The edge processing circuit 73 is configured to read the four-level value data stored in the four-level value data storage buffer 72 and to perform edge processing on the four-level value data. Specifically, as illustrated in FIG. 4B, the edge processing circuit 73 successively sets respective dot elements included in the four-level value data as a noticed dot element (a dot element of interest). Then, the edge processing circuit 73 sets a 3×3 matrix region around the noticed dot element as a process target region to be processed, and detects whether or not the noticed dot element corresponds to an edge portion of an image on the basis of density values set for the dot elements in the process target region. Specifically, the edge processing circuit 73 detects whether the noticed dot element corresponds to an edge portion of an image by performing a known Sobel filter operation using both a Sobel filter corresponding to a differential filter in the main scanning direction and a Sobel filter corresponding to a differential filter in the sub-scanning direction.

When the noticed dot element is detected as an edge portion of an image, the edge processing circuit 73 performs an operation of reducing the density value set for the noticed dot element. For example, when the density value set for the noticed dot element is "10" or "11", the edge processing circuit 73 reduces the value of "10" or "11" to "01". When the density values set for the noticed dot element is "01", the edge processing circuit 73 reduces the value of "01" to "00". In this way, the amount of ink ejected to the edge portion of the image can be reduced. As a result, the edge portion of the image can be made sharp without being blurred. The four-level value data on which the edge processing circuit 73 executes the edge processing is stored in the ejection data storage buffer 74 as ejection data.

The mechanical system driving control circuit 75 is configured to control each of the first motor 21*c* and the second motor 22*c* of the conveying mechanism 20 on the basis of a control signal from the CPU 52.

The head control circuit 76 controls the head 1 to record, on the paper P conveyed by the conveying mechanism 20, an image associated with the ejection data stored in the ejection data storage buffer 74, according to a control signal from the CPU 52. Specifically, the head control circuit 76 rearranges the ejection data stored in the ejection data storage buffer 74 in accordance with an arrangement pattern of the nozzles 8 of the head 1, and then generates a waveform selection signal matching the arrangement pattern of the nozzles 8. As mentioned above, the waveform selection signal is a signal for indicating any one of the four types of driving waveform signals. Then, the head control circuit 76 outputs the generated waveform selection signal together with the four types of driving waveform signals to the driver IC 5*b* of the head 1. In this embodiment, the head control circuit 76 generates the waveform selection signal such that ink droplets are ejected from the nozzles 8 in synchronization with the pulse signal output by the rotary encoder 25. Therefore, ink droplets are ejected from the nozzles 8 at a timing corresponding to a conveyance amount per unit time for which the paper P is conveyed by the first conveying unit 21.

Figure 5A:
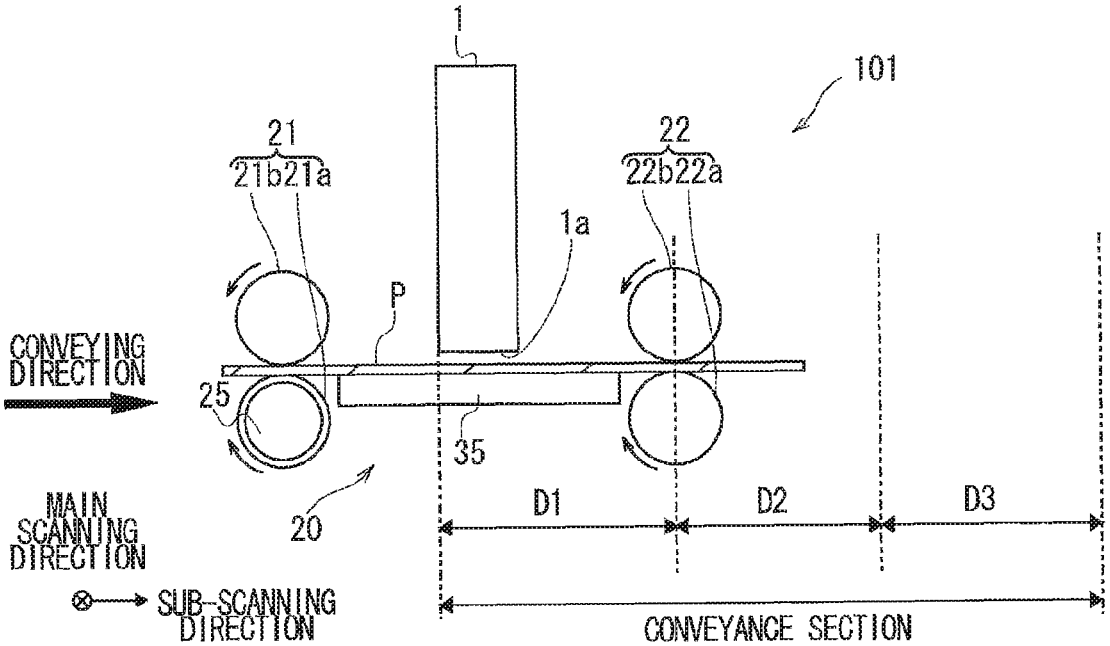
FIGS. 5A and 5B are explanatory diagrams illustrating conveyance of a sheet conveyed by a conveying mechanism of the inkjet printer shown in FIG. 1.
Figure 5B:
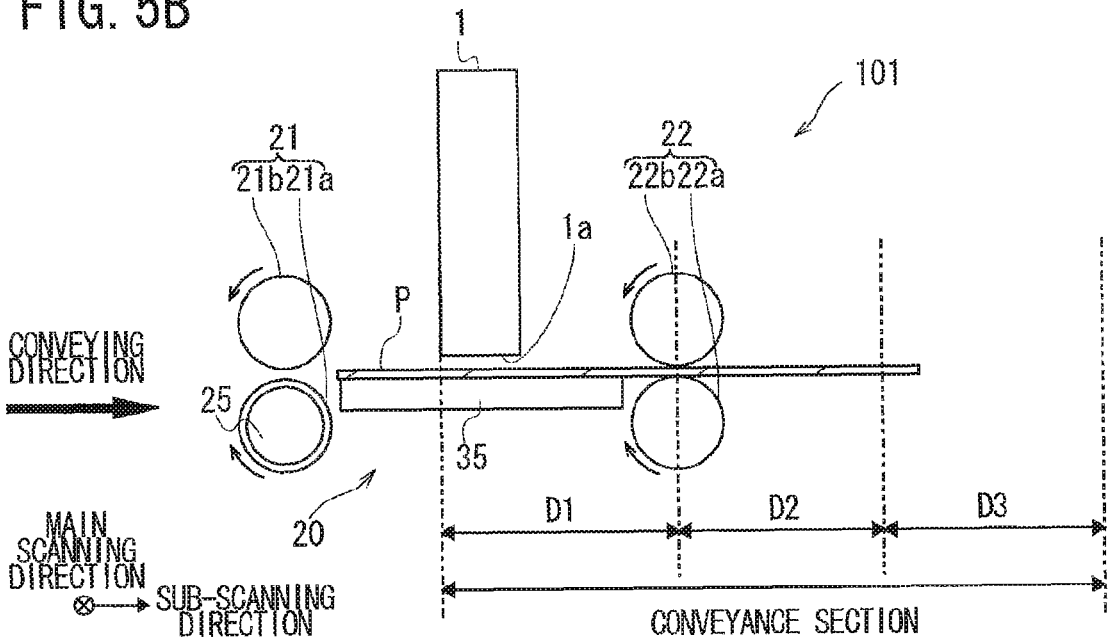

Next, the correction processing executed by the RIPCPU 56 will be described below. In this embodiment, as illustrated in FIGS. 5A and 5B, a conveyance section through which the paper P is conveyed by the conveying mechanism 20 is divided into three divisional sections D1 to D3. The conveyance section corresponds to a range between: a position at which the downstream end (leading end) of the paper P in the conveying direction reaches the ejection region facing the ejection surface 1*a*; and a position at which the upstream end (trailing end) of the paper P in the conveying direction passes through the downstream end of the ejection region in the conveying direction.

The divisional section D1 is the most-upstream section in the conveying direction among the three divisional section D1 to D3, and is a section in which the conveying force is applied to the paper P only from the first conveying unit 21 (see FIG. 1). In the divisional section D1, the paper P is conveyed at the conveyance speed V1 by the conveying force applied from the first conveying unit 21 (see FIG. 6(A)).

Figure 6:
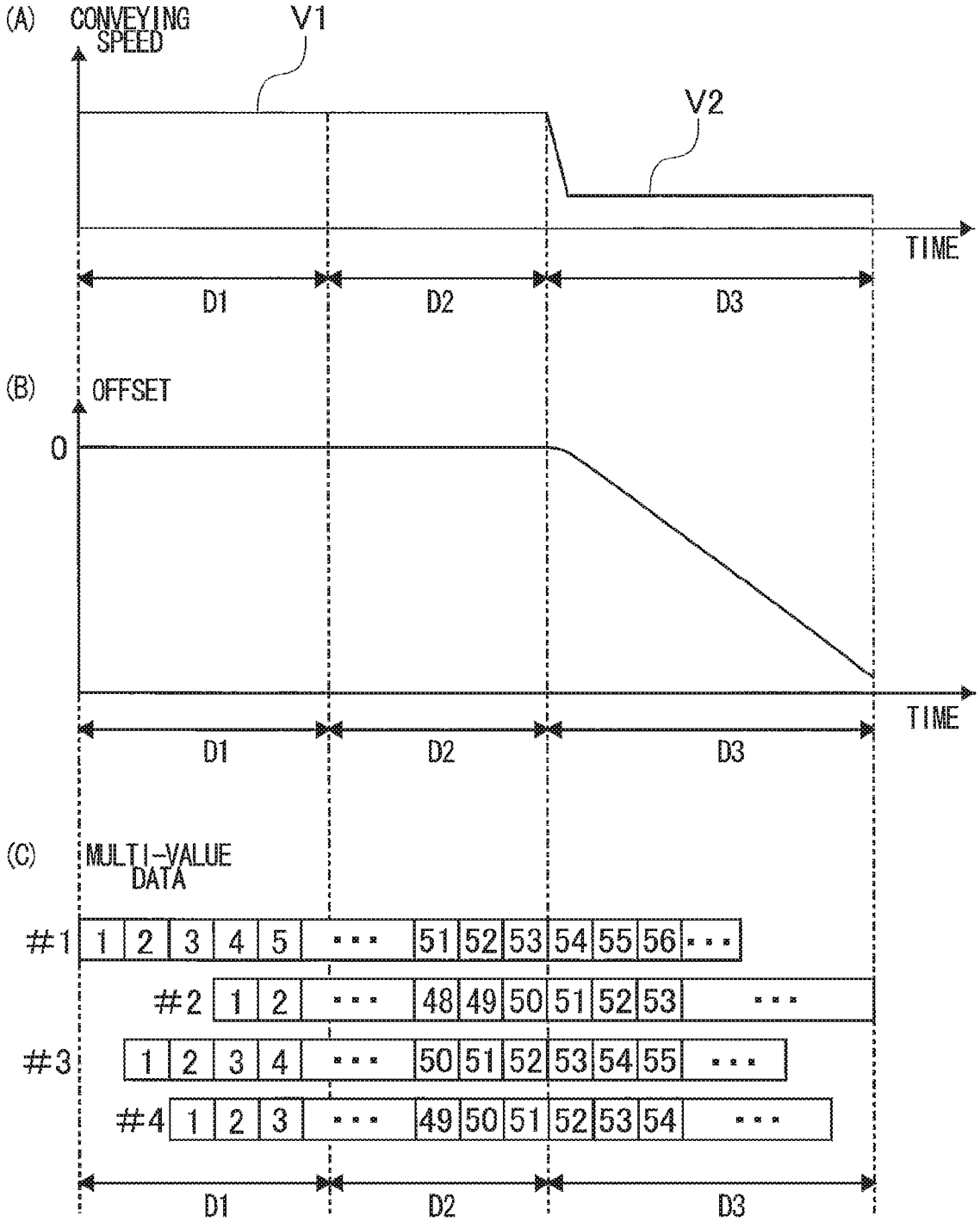
FIG. 6 is an explanatory diagram illustrating changes per time in (A) conveying speed; (B) offsets; and (C) ejection timings.

The divisional section D2 is the middle section in the conveying direction among the three divisional section D1 to D3, and is a section in which the conveying force is applied to the paper P from both the first conveying unit 21 and the second conveying unit 22 as illustrated in FIG. 5A. A start point of the divisional section D2 is a position at which the leading edge (the downstream end) of the paper P reaches the second conveying unit 22 (that is, a nip point between the conveying rollers 22*a* and 22*b*). As described in the foregoing, the nip force at which the paper P is sandwiched between the conveying rollers 21*a* and 21*b* is set so as to be greater than the nip force at which the paper P is sandwiched between the conveying rollers 22*a* and 22*b*. Thus, the paper P is conveyed at the same conveyance speed as the conveyance speed V1 in the divisional section D2, as illustrated in FIG. 6(A). In other words, a conveyance amount of the paper P per unit time in the divisional section D1 is the same as a conveyance amount of the paper P per unit time in the divisional section D2. Hereinafter, the conveyance amount of the paper P per unit time in the divisional sections D1 and D2 will be referred to as a "reference conveyance amount" per unit time.

The divisional section D3 is the most-downstream section in the conveying direction among the three divisional section D1 to D3, and is a section in which the conveying force is applied to the paper P only from the second conveying unit 22 as illustrated in FIG. 5B. A start point of the divisional section D3 is a position at which the trailing edge (the upstream end) of the paper P is released from the nip point of the first conveying unit 21. As illustrated in FIG. 6(A), the conveyance speed V2 of the paper P in the divisional section D3 decreases from the conveyance speed V1 with a duration until the predetermined period of time has elapsed since the paper P is released from the nip point of the first conveying unit 21, and then becomes a constant speed after the predetermined period of time elapsed. In other words, the conveyance speed V2 of the paper P in the divisional section D3 is lower than the conveyance speed V1. As a result, a conveyance amount of the paper P per unit time in the divisional section D3 is smaller than the reference conveyance amount per unit time (that is, the conveyance amount of the paper P per unit in the divisional sections D1 and D2). In this embodiment, the divisional sections D1 and D2 correspond to a first divisional section, and the divisional section D3 corresponds to a second divisional section.

Incidentally, ink droplets need to be ejected from the nozzles 8 at appropriate ejection timings based on the conveyance amount of the paper P per unit time in order to form a high-quality image on the paper P. In the embodiment, ink ejection operation is performed on the basis of the pulse signal output from the rotary encoder 25 attached to the conveying roller 21*a* of the first conveying unit 21. That is, the ink ejection operation is performed on the assumption that the paper P is conveyed the reference conveyance amount per unit time when the paper P is conveyed in the conveyance section including the divisional sections D1 to D3. Accordingly, ink droplets are ejected from the nozzles 8 at appropriate ejection timings based on the conveyance amount of the paper P per unit time (the conveyance speed), during a period in which the paper P is conveyed in the divisional sections D1 and D2. Therefore, as illustrated in FIG. 6(B), a deviation amount in the conveying direction between a position on the paper P at which a dot is to be formed (an ideal formation position) and a position on the paper P at which the dot is actually formed (an actual dot formation position) becomes substantially zero in the period in which the paper P is conveyed in the divisional sections D1 and D2.

However, during a period in which the paper P is conveyed in the divisional section D3, the paper P is conveyed at the conveyance speed V2 lower than the conveyance speed V1. Thus, a distance at which the paper P is conveyed in the divisional section D3 during one ejection period is shorter than a distance at which the paper P is conveyed in the divisional sections D1 and D2 during one ejection period. For this reason, a dot pitch in the conveying direction between dots formed on the paper P when the paper P is conveyed in the divisional section D3 is shorter than that when the paper P is conveyed in the divisional sections D1 and D2. As a result, in the period in which the paper P is conveyed in the divisional section D3, offsets (deviation amount) in the conveying direction between an ideal formation position of a dot on the paper P and an actual formation position thereof increases over time as illustrated in FIG. 6(B). Accordingly, quality of an image formed on the paper P deteriorates. FIG. 6(B) is illustrated such that the deviation amount of dots has a negative value when the actual formation position of the dots is shifted to the upstream side in the conveying direction from the ideal formation position.

In the embodiment, the head 1 includes the plurality of nozzles 8 arranged so as to form the thirty-two nozzle arrays 8*a* lined up in the conveying direction. As a result, when the paper P is conveyed at the conveyance speed V2 lower than the conveyance speed V1 in the divisional section D3, an image formed on the paper P is distorted in the conveying direction according to arrangement of the nozzles 8. Hereinafter, data consisting of dot elements having the same order in each of dot data rows contained in the multi-value data is referred to as "raster data". An order of a dot element indicates a position of the dot element in a data array direction of the corresponding one dot data row. The data array direction is a direction in which the dot elements corresponding to one nozzle 8 are arranged.

The raster data is data relating to the recording of a dot line on the paper P. The dot line extends in the main scanning direction. In case that all nozzles 8 are arranged in the same one nozzle array 8*a*, dots corresponding to dot elements included in the raster data are formed in the same ejection period (at the same timing) in order to form a straight line extending in the main scanning direction on the paper P. However, in case that the head 1 includes the plurality of nozzle arrays 8*a* at the different positions in the conveying direction as in this embodiment, dots corresponding to dot elements of the raster data and corresponding to different nozzle arrays 8*a* are formed in different ejection periods (at different timings), as illustrated in FIG. 6(C). FIG. 6(C) schematically illustrates ejection timings of dots for respective dot elements arranged in four dot data rows corresponding to the nozzle arrays #1 to #4. In the FIG. 6(C), numbers illustrate sequence numbers of the respective dot elements in each dot data row. A sequence number of each dot element indicates an order of the dot element among the dot elements arranged in the data array direction in the corresponding one dot data row. The sequence number of a dot element also corresponds to a position of the dot element in the data array direction).

When all the plurality of dots corresponding to the plurality of dot elements included in the raster data is formed on the paper P in the period in which the paper P is conveyed in the divisional sections D1 and D2, a deviation amount in the conveying direction of the all dots is substantially zero, and thus the dots are formed on a straight line extending in the main scanning direction. However, when the plurality of dots corresponding to the plurality of dot elements included in one set of raster data includes one or more dots formed in the period in which the paper P is conveyed in the divisional section D3, the dots cannot be formed on a straight line extending in the main scanning direction. This is because these dots are formed at different timings for each of the nozzle arrays 8*a*, and thus deviation amounts of the dots formed during the period of time in which the paper P is conveyed in the divisional section D3 are different between the dots corresponding to different nozzle arrays 8*a*.

Figures 7A, 7B:
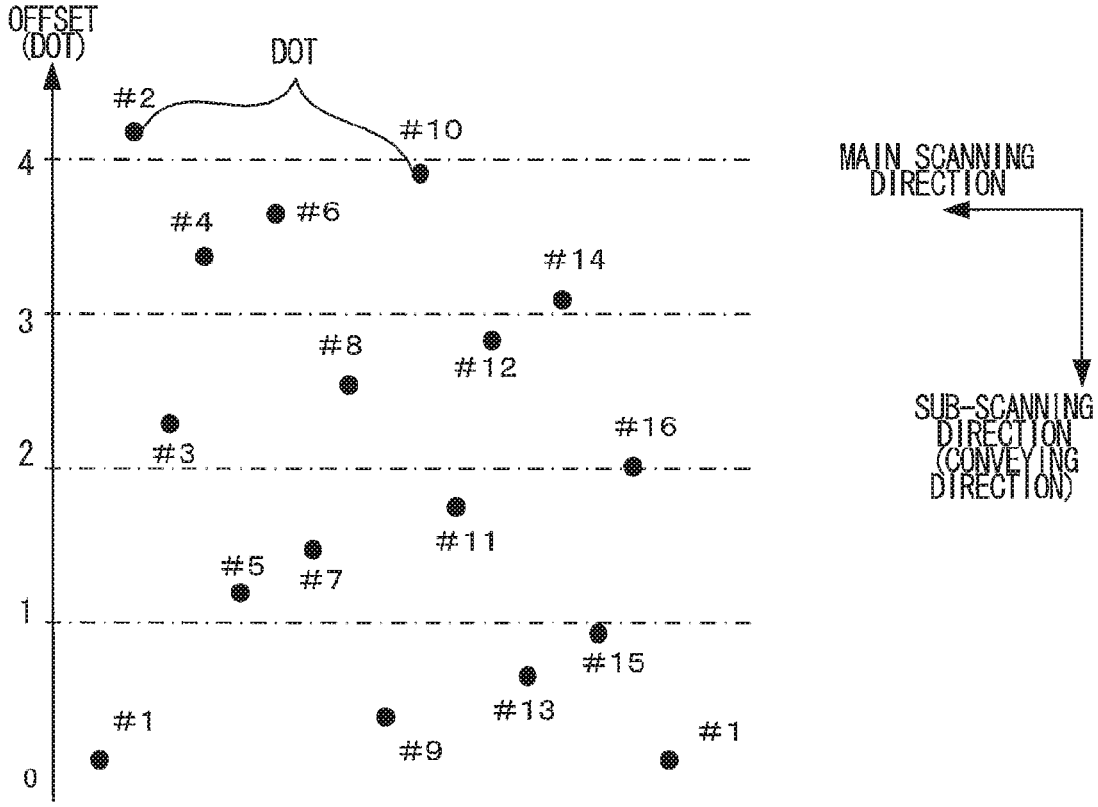
FIG. 7A is an explanatory diagram showing offset of dot formation positions for nozzles used for forming dots relating to raster data.
FIG. 7B is a table representing a number of dot elements for correction for each nozzle row.
Figure 8:
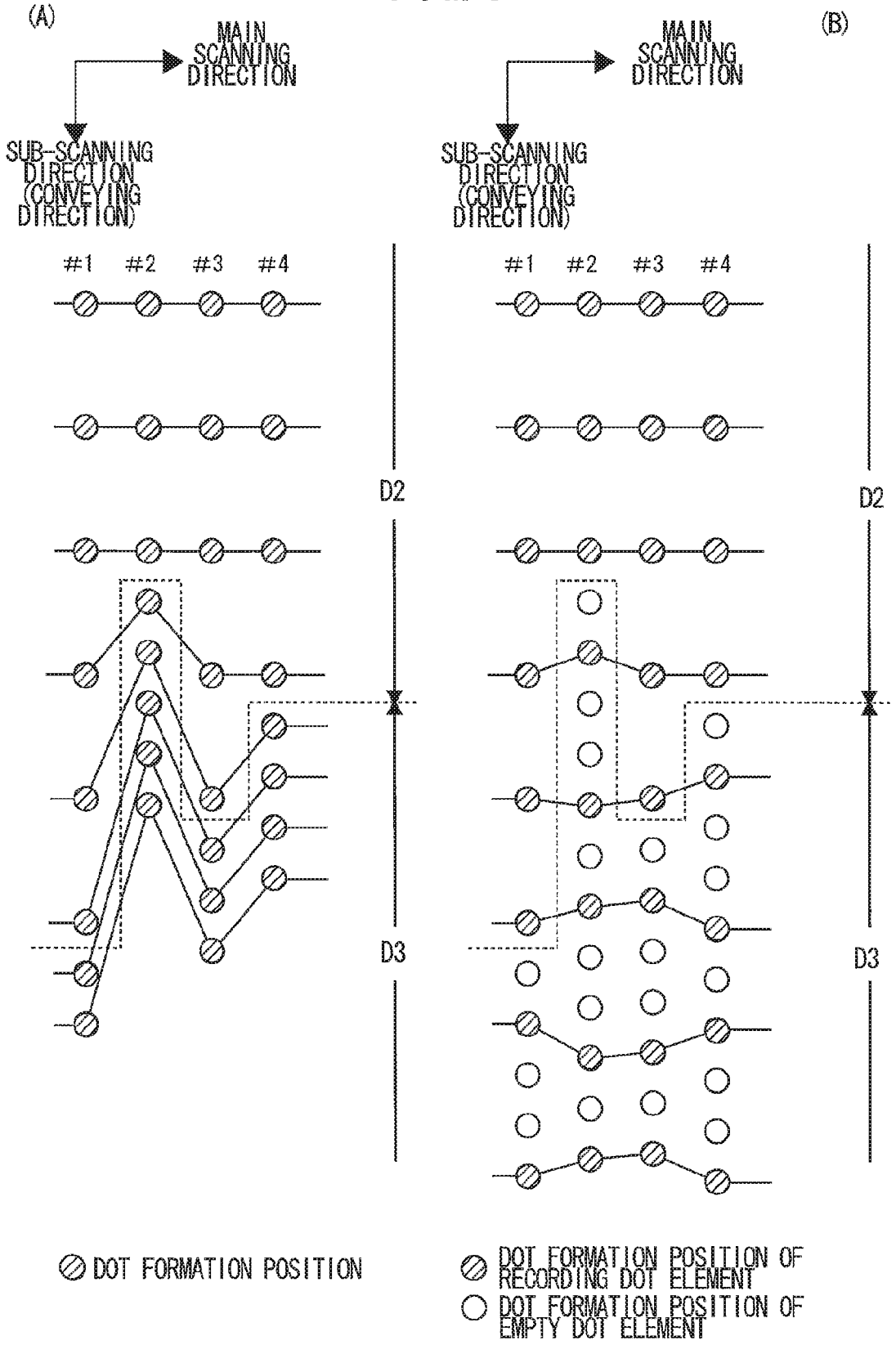
FIG. 8 is an explanatory diagram showing (a) dot formation positions when the correction is not executed and (b) dot formation positions when the correction is executed in the embodiment.

Therefore, for example, when all dots corresponding to dot elements included in the one raster data are formed in the period of time in which the paper P is conveyed in the divisional section D3, dot formation positions in the conveying direction for respective nozzle arrays 8*a* are different as illustrated in FIG. 7A. For this reason, decreased image quality can be occurred while the image is recorded in the period in which the paper P is conveyed in the divisional section D3, as illustrated in FIG. 8A. In particular, if the image formed in the period in which the paper P is conveyed in the divisional section D3 corresponds to a ruled line extending in the main scanning direction or a line image extending in the main scanning direction such as a bar code in which a striped pattern extends in the main scanning direction, the reduction of quality is easily noticeable. In FIG. 8(A), dots corresponding to dot elements to be corrected (to-be-corrected dot elements described below) included in the same one set of raster data are connected by a solid line for convenience of description.

In this embodiment, in case that the line image extending in the main scanning direction is included in the image formed in the period in which the paper P is conveyed in the divisional section D3, the RIPCPU 56 executes correction processing for correcting the multi-value data to prevent decreased quality of the line image. Hereinafter, multi-value data prior to the correction processing is referred to as pre-correction data, and multi-value data subsequent to the correction processing is referred to as post-correction data.

Figure 7C:
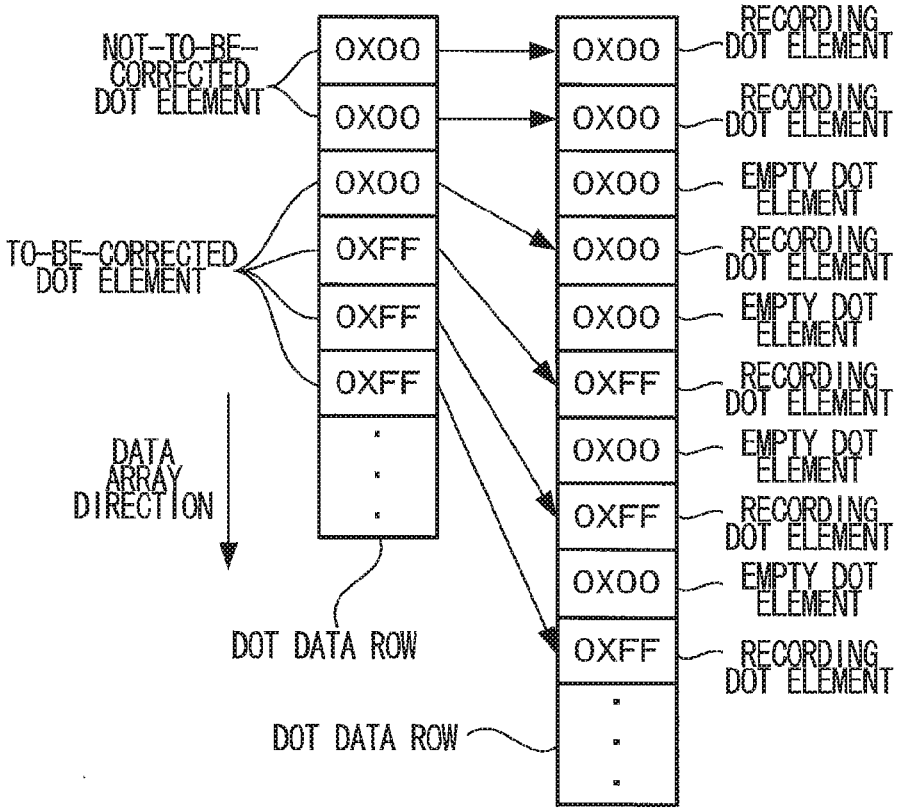
FIG. 7C is an explanatory diagram showing correction processing executed by the inkjet printer shown in FIG. 1.

The correction processing will be described. First, dot elements in the pre-correction data corresponding to dots to be formed in the period in which the paper P is conveyed in the divisional section D3 are set to dot elements to be corrected (hereinafter, to-be-corrected dot elements). Dot elements in the pre-correction data corresponding to dots formed in the period in which the paper P is conveyed in the divisional sections D1 and D2 are set to dot elements not to be corrected (hereinafter, not-to-be-corrected dot element). In other words, as illustrated in FIG. 7C, a density value of the not-to-be-corrected dot element in the pre-correction data is set as a density value of a dot element in the post-correction data corresponding to the not-to-be-corrected dot element. Each dot element corresponding to one not-to-be-corrected dot element is a dot element included in the post-correction data and having a dot number that is the same as the dot number of the one not-to-be-corrected dot element in the pre-correction data. Each dot number indicates a position of one dot element in the data array direction in which the dot elements are arranged in the dot data row.

A correction amount for each to-be-corrected dot element is based on a deviation amount (or an offset) in the conveying direction of a dot corresponding to the to-be-corrected dot element. In this embodiment, the correction amounts of the respective to-be-corrected dot elements are pre-stored in the RAM 54. The correction amounts may be obtained by actually recording an image on the paper P to measure dot formation positions in advance, and may be obtained by simulation.

The RIPCPU 56 obtains the number of dot elements for correction based on the correction amounts for each to-be-corrected dot element. The number of dot elements for correction for a to-be-corrected dot element indicates the number of dot elements corresponding to a difference in the data array direction in the dot data row between: a dot element corresponding to a dot whose actual formation position is closest to the ideal formation position of the dot corresponding to the to-be-corrected dot element; and the to-be-corrected dot element. For example, for dot elements included in the raster data illustrated in FIG. 7A, an actual formation position of a dot corresponding to a to-be-corrected dot element associated with the nozzle array #2 is shifted from an ideal formation position of the dot by about four dots. In other words, the ideal formation position of the dot corresponding to the to-be-corrected dot element associated with the nozzle array #2 is closest to an actual formation position of a dot corresponding to a dot element that is fourth dot element from the to-be-corrected dot element (that is, a dot element positioned downstream from the to-be-corrected dot element for four dot elements) in the array direction of the dot elements. Therefore, the number of dot elements for correction set for the to-be-corrected dot element associated with the nozzle array #2 is obtained to be 4. The number of dot elements for correction is obtained in a similar manner, for each of to-be-corrected dot elements included in the raster data illustrated in FIG. 7A and associated with remaining nozzle arrays. FIG. 7B illustrates the number of dot elements for correction set for each of the to-be-corrected dot elements corresponding to the nozzle arrays #1 to #16 and included in the raster data illustrated in FIG. 7A. As can be understood from FIG. 7B, the number of dot elements for correction set for the to-be-corrected dot element included in the raster data increases, as the deviation amount in the conveying direction of a dot corresponding to the to-be-corrected dot element increases.

As illustrated in FIG. 7C, the RIPCPU 56 sets a density value that has been set for each to-be-corrected dot element of the pre-correction data, as a density value of a dot element that is included in the post-correction data and positioned downstream the number of dot elements for correction from a dot element of the same order as the to-be-corrected dot element in the pre-correction data. That is, the density value of one to-be-corrected dot element in the pre-correction data is equal to the density value of a dot element that is included in the post-correction data and separated from a position in the post-correction data corresponding to the one to-be-corrected dot element by the number of dot elements for correction. Hereinafter, a dot element included in the post-correction data and whose density value is set to a density of any one of dot elements of the pre-correction data is referred to as a "recording dot element". Further, a dot corresponding to the recording dot element is referred to as a "recording dot". Data including recording dot elements, in which respective density values of to-be-corrected dot elements included in the raster data of the pre-correction data are set, is referred to as "post-correction raster data". A dot element, in which any one of density values of dot elements of the pre-correction data is not set, among dot elements of the post-correction data is referred to as an "empty dot element". Further, a dot corresponding to the empty dot element is referred to as an "empty dot". The density value of the empty dot element is set to the smallest gradation value (zero in the embodiment) among 255 gradation values. The smallest gradation value corresponds to an amount of ejected ink being zero.

In this embodiment, as mentioned above, the conveyance amount of the paper P per unit time in the period in which the paper P is conveyed in the divisional section D3 is smaller than the conveyance amount (the reference conveyance amount) of the paper P per unit time in the period in which the paper P is conveyed in the divisional sections D1 and D2. Therefore, when two adjacent to-be-corrected dots including one to-be-corrected dot element (a preceding to-be-corrected dot element) and another to-be-corrected dot element (a subsequent to-be-corrected dot element) disposed downstream from the one to-be-corrected dot element in the data array direction are arranged in the same dot data row of the pre-correction data, the number of dot elements for correction for the subsequent to-be-corrected dot element is inevitably greater than or equal to the number of dot elements for correction for the preceding to-be-corrected dot element. For this reason, density values of two to-be-corrected dot elements that are adjacent in the same dot data row in the pre-correction data are not set for the same one dot element in the post-correction data. That is, a density value of one of two different dot elements of the post-correction data is set to the density value of the subsequent to-be-corrected dot element in the pre-correction data, while the other of two different dot elements of the post-correction data is set to the density value of the preceding to-be-corrected dot element in the pre-correction data. As a result, density values set for respective dot elements of the pre-correction data are not missed after the correction is performed. Thus, decrease of the image quality can be reduced.

The above-described method of generating the post-correction data based on the pre-correction data can adjust formation positions of dots based on dot elements included in the post-correction raster data and corresponding to the to-be-corrected dot elements included in the pre-correction data to approach the ideal formations of dots based on the to-be-corrected dot elements included in the pre-correction data, as shown in FIG. 8(B). In this way, offsets of dot recording positions in the conveying direction on the paper P due to difference in positions of the nozzle arrays 8*a* can be reduced. In FIG. 8(B), recording dots corresponding to one set of the post-correction raster data are connected by a solid line for convenience of description.

Figure 9:
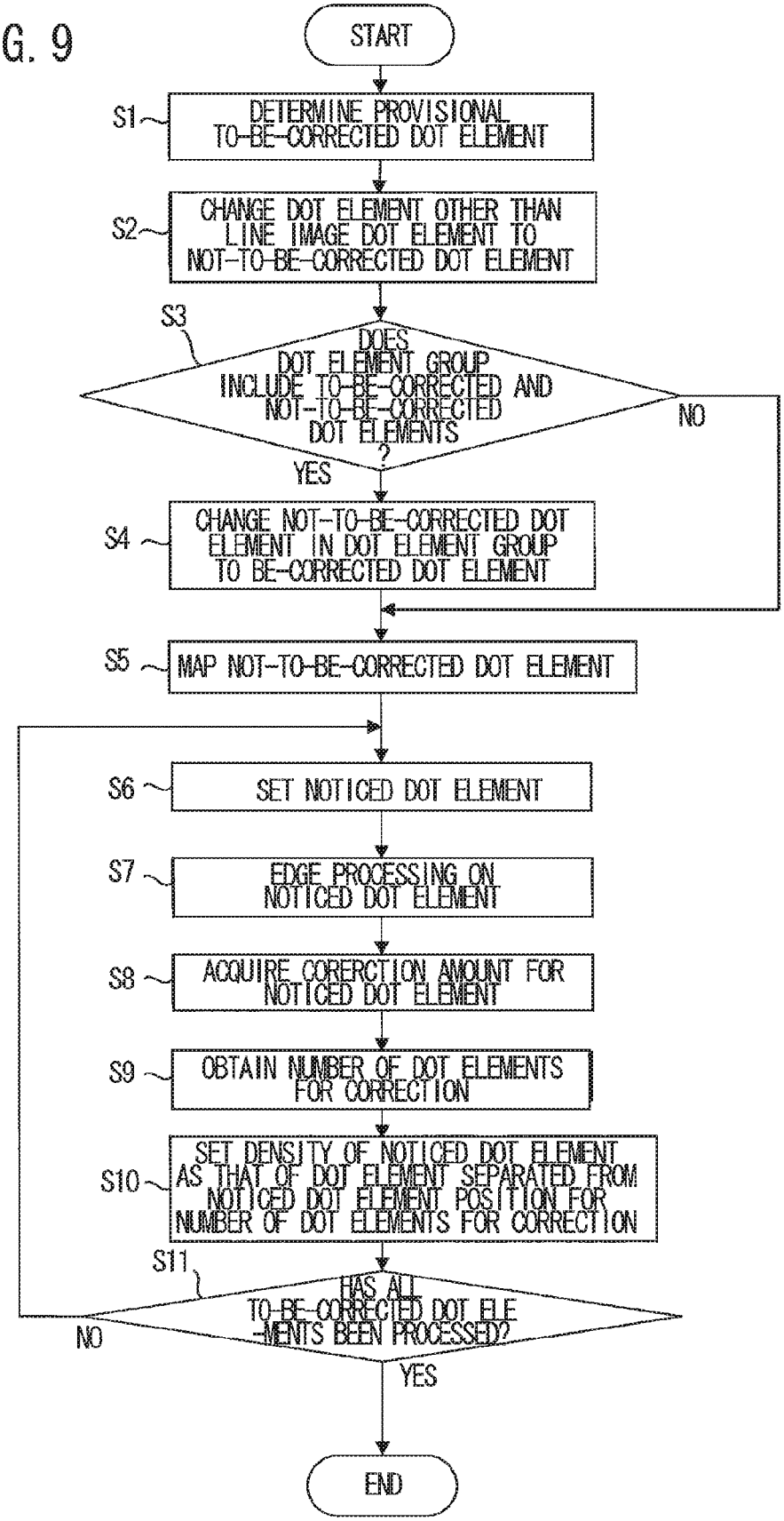
FIG. 9 is a flowchart illustrating steps in the correction processing according to the embodiment.

Hereinafter, details of the correction processing executed by the RIPCPU 56 will be described with reference to FIG. 9.

In S1, the RIPCPU 56 reads pre-correction data stored in the multi-value data storage memory 57, and provisionally determines a to-be-corrected dot element among a plurality of dot elements included in the read pre-correction data. Specifically, the RIPCPU 56 provisionally determines, as the to-be-corrected dot elements, dot elements corresponding to dots formed in the period in which the paper P is conveyed in the divisional section D3 among the plurality of dot elements included in the pre-correction data.

Subsequently, the RIPCPU 56 executes image determination processing on each provisional to-be-corrected dot element to determine whether the provisional to-be-corrected dot element corresponds to a line image dot element. The line image dot element is related to recording a line image extending in the main scanning direction. In S2 the RIPCPU 56 changes, to a not-to-be-corrected dot element, each provisional to-be-corrected dot element that is determined not to be the line image dot element. Through the process of S2, the RIPCPU 56 excludes a provisional to-be-corrected dot element that is not related to the line image from the target for correction. Thus, the processing load of the RIPCPU 56 can be reduced. The determination of whether each provisional to-be-corrected dot element corresponds to the line image dot element may be made by actually analyzing the pre-correction data. Further, determination of the provisional to-be-corrected dot element may be made in a manner such that the external terminal device 200 has added position information about the line image to print data and then the RIPCPU 56 refers the position information added to the print data that is received by the inkjet printer 101.

Incidentally, there is a case in which a dot element regarded as a to-be-corrected dot element in the pre-correction data due to an error distributed in the error diffusion processing is actually a not-to-be-corrected dot element (that is, dot element corresponding to a dot formed in the period in which the paper is conveyed in the divisional sections D1 and D2, in this embodiment). Similarly, there is a case in which a dot element regarded as a not-to-be-corrected dot element in the pre-correction data due to an error distributed in the error diffusion processing is actually a to-be-corrected dot element. In these cases, a dot element that originally needs to be corrected is not corrected, and a dot element that does not require correction is corrected. As a result, such an improperly-processed dot element can cause a larger offset between an ideal formation position and actual formation position of the dot corresponding to the improperly-processed dot element. For example, if an image is printed on the paper P, consists of ejection dots formed by the impacted ink droplets, and is surrounded by non-ejection dots and a dot having the larger offset of the formation position is included in the image, a white line may be formed within the image. The "dot having the larger offset of the formation position" means a dot whose actual formation position is greatly shifted from the ideal formation position thereof. The white line formed in the image can decrease the image quality. That is, if a group of dot elements relating to an image includes the to-be-corrected dot elements and the not-to-be-corrected dot elements, the correction on only the to-be-corrected dot elements may cause larger decrease in quality of the image.

Figure 7D:
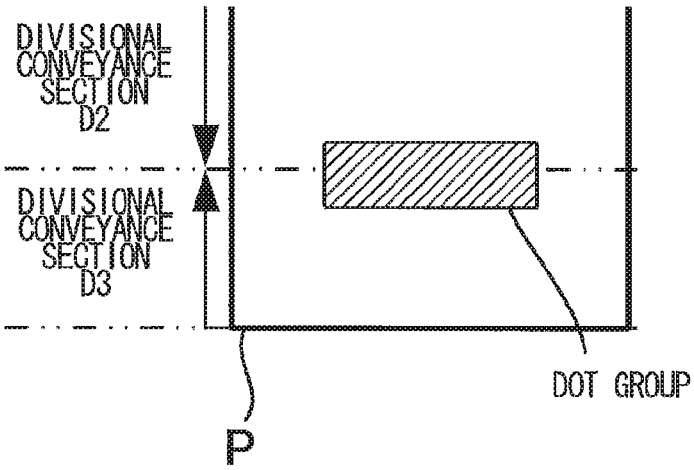
FIG. 7D is an explanatory diagram showing an example of a dot group.

In this regard, the RIPCPU 56 extracts a target dot element group from the pre-correction data in the embodiment. The target dot element group is a set of dot elements each having a density value corresponding to the amount of ink ejected from the nozzle 8 greater than zero, and is surrounded by dot elements each having a density value corresponding to the amount of ink ejected from the nozzle 8 being zero. Then, the RIPCPU 56 determines whether each of the extracted target dot element groups includes at least one to-be-corrected dot element and at least one not-to-be-corrected dot element (S3). In other words, the RIPCPU 56 determines whether or not a group of dots to be recorded on the paper P on the basis of each target dot element group is a group of dots including: a dot to be formed in the period in which the paper P is conveyed in the divisional section D2; and a dot formed in the period in which the paper P is conveyed in the divisional section D3 (see FIG. 7D).

Then, when the RIPCPU 56 determines that there is no dot element group including the to-be-corrected dot element and the not-to-be-corrected dot element (NO in S3), the process proceeds to S5. On the other hand, when the RIPCPU 56 determines that there is a dot element group including at least one to-be-corrected dot element and at least one not-to-be-corrected dot element (YES in S3), the RIPCPU 56 changes each of the at least one not-to-be-corrected dot element included in the dot element group to a to-be-corrected dot element in S4. In this way, if one dot element group corresponding to one image includes at least one to-be-corrected dot element and at least one not-to-be-corrected dot element, the correction processing is performed on all dot elements included in the one dot element group. Accordingly, a possibility of decreased quality of image can be reduced. As a modification of the embodiment, the RIPCPU 56 may change each to-be-corrected dot element included in the target dot element group to a not-to-be-corrected dot element. The RIPCPU 56 determines a definitive to-be-corrected dot element targeted to be corrected, through the processing of S2 to S4.

In S5, the RIPCPU 56 executes mapping dot elements in the post-correction data by setting a density value of each of the not-to-be-corrected dot elements included in the pre-correction data, as a density value of corresponding one dot element included in the post-correction data. In S6, the RIPCPU 56 selects one of the to-be-corrected dot elements of the pre-correction data as a noticed dot element. In S7, the RIPCPU 56 performs edge processing on a process target region of the pre-correction data. The process target region is a 3×3 matrix region in which the noticed dot element is centered. The edge processing of S7 is similar to the edge processing executed by the processing circuit 73.

If the edge processing is performed on the post-correction data, an edge portion in the image may not be appropriately processed. This is because there is a possibility that a density value set for a to-be-corrected dot element in the pre-correction data may be set as a density value for a dot element of the post-correction data whose order in the data array direction is different from the order of the to-be-corrected dot element of the pre-correction data. In the embodiment, the RIPCPU 56 performs the edge processing on the pre-correction data. Accordingly, the edge processing can be reliably executed on the edge portion in the image. Further, the edge processing may be performed in advance before the correction processing is performed on the pre-correction data.

As mentioned above, the quantization circuit 63 generates four-level value data by performing the error diffusion processing on the multi-value data (the post-correction data). There is concern that the error diffusion processing may not be appropriately performed if a density value of one to-be-corrected dot element of the pre-correction data is set as a density value of a dot element of the post-correction data having the different order from that of the one to-be-corrected dot element of the pre-correction data. However, this embodiment is configured such that the correction processing is performed only on a part of image data corresponding to a line image such as a bar code. Here, when the line image such as the bar code is black, the density value corresponding to highest gradation value is set as a density value for each of dot elements corresponding to dots constituting of the line image. The dot element for which the density value corresponding to the highest gradation value is set has less possibility of generation of an error to be diffused to a dot element around the dot element even when the error diffusion processing is performed on such dot element. Accordingly, correction on image data on which the error diffusion processing has not yet been performed is unlikely to affect the error diffusion processing.

Subsequently, the RIPCPU 56 acquires a correction amount for the noticed dot element stored in the RAM 54 in advance in S8, and obtains the number of dot elements for correction corresponding to the acquired correction amount in S9. In S10, the RIPCPU 56 executes correction on the noticed dot element by setting a density value for the notice dot element in the pre-correction data (the pre-correction data in this sentence including the pre-correction data on which the edge processing has been executed), as a density value for a dot element of the post-correction data whose number indicative of the order in the data array direction is larger, for the number of dot elements for correction corresponding to the to-be-corrected dot element, than the number indicative of the order of the corresponding to-be-corrected dot element in the post-correction data. In other words, a density value of a to-be-corrected dot element is set for a dot element of the post-correction data that corresponds to the to-be-corrected dot element and positioned downstream for the number of dot elements from the position of the to-be-corrected dot element in the data array direction.

Thereafter, in S11, the RIPCPU 56 determines whether all to-be-corrected dot elements of the pre-correction data are selected as a noticed dot element. When any one of the to-be-corrected dot elements of the pre-correction data is determined not to be selected as the noticed dot element (NO in S11), the flow returns to S6. On the other hand, when all to-be-corrected dot elements in the pre-correction data are determined to be selected as the noticed dot element (YES in S11), the RIPCPU 56 ends the correction processing. The RIPCPU 56 generates the post-correction data through the above-described correction processing.

In the embodiment described above, a correction amount for each to-be-corrected dot element is the same as the difference between: a position at which a dot corresponding to the to-be-corrected dot element is formed on the paper P when the paper P is conveyed a conveyance amount per unit time in any one of the divisional sections D1 to D3; and a position at which the dot is formed on the paper P when the paper P is conveyed the reference conveyance amount per unit time. A density value set for each to-be-corrected dot element is set as a density value for a dot element separated from the each to-be-corrected dot element by the number of dot elements corresponding to the correction amount (offset) of the each to-be-corrected dot element. In this way, using a simple configuration, a deviation in the conveying direction of dot recording positions on the paper P due to the positions of nozzle arrays 8*a* can be corrected and dot pitch in the conveying direction of dots corresponding to recording dot elements and formed on the paper P can be made substantially the same.

In the embodiment described above, the reference conveyance amount is set to the conveyance amount per unit time in the divisional sections D1 and D2 in which a conveyance speed of the paper P is highest, and operations of ejecting ink droplets are performed on the assumption that the paper P is conveyed for the reference conveyance amount per unit time in the conveyance section. As a result, a dot pitch between two dots, that correspond to two dot elements adjacent to each other in the same dot data row and formed within the period in which the paper P is conveyed in the divisional section D3, is smaller than a dot pitch between two dots that correspond to two dot elements adjacent to each other and formed within the period in which the paper P is conveyed in the divisional sections D1 and D2. Therefore, one dot element in the post-correction data is selected as a dot element to be associated with both density values for two adjacent dot elements in the same dot data row in the pre-correction data. In other words, the density values for the two adjacent dot elements in the pre-correction data are set as the density values for different two dot elements in the post-correction data. As a result, density values set for all dot elements of the pre-correction data are included in the post-correction data, and deterioration of the image quality can be reduced.

In the embodiment described above, if a dot element group, which consists of dot elements corresponding to dots constituting of one image, includes at least one to-be-corrected dot element and at least one not-to-be-corrected dot element, the same processing is performed on all dot elements included in the dot element group. Specifically, if the dot element group includes the to-be-corrected dot elements and the not-to-be-corrected dot elements, the correction is performed on all dot elements included in the dot element group or the correction is not performed on all dot elements included in the dot element group. Accordingly, it is possible to prevent decrease of an image quality in one image including dots corresponding to the to-be-corrected dot elements and dots corresponding to the not-to-be-corrected dot elements.

In the embodiment described above, the RIPCPU 56 performs the correction on only the to-be-corrected dot elements each corresponding to a dot included in the line image extending in the main scanning direction, among the provisional to-be-corrected dot elements. In other words, the correction processing is not executed on a provisional to-be-corrected dot element that is not related to recording of the line image. Accordingly, processing load of the RIPCPU 56 can be reduced while decreased image quality of the line image can be prevented.

In the embodiment above described, the edge processing is performed on the pre-correction data, and thus the edge processing can be reliably performed on an edge portion of an image.

(Modification)

Figure 10:
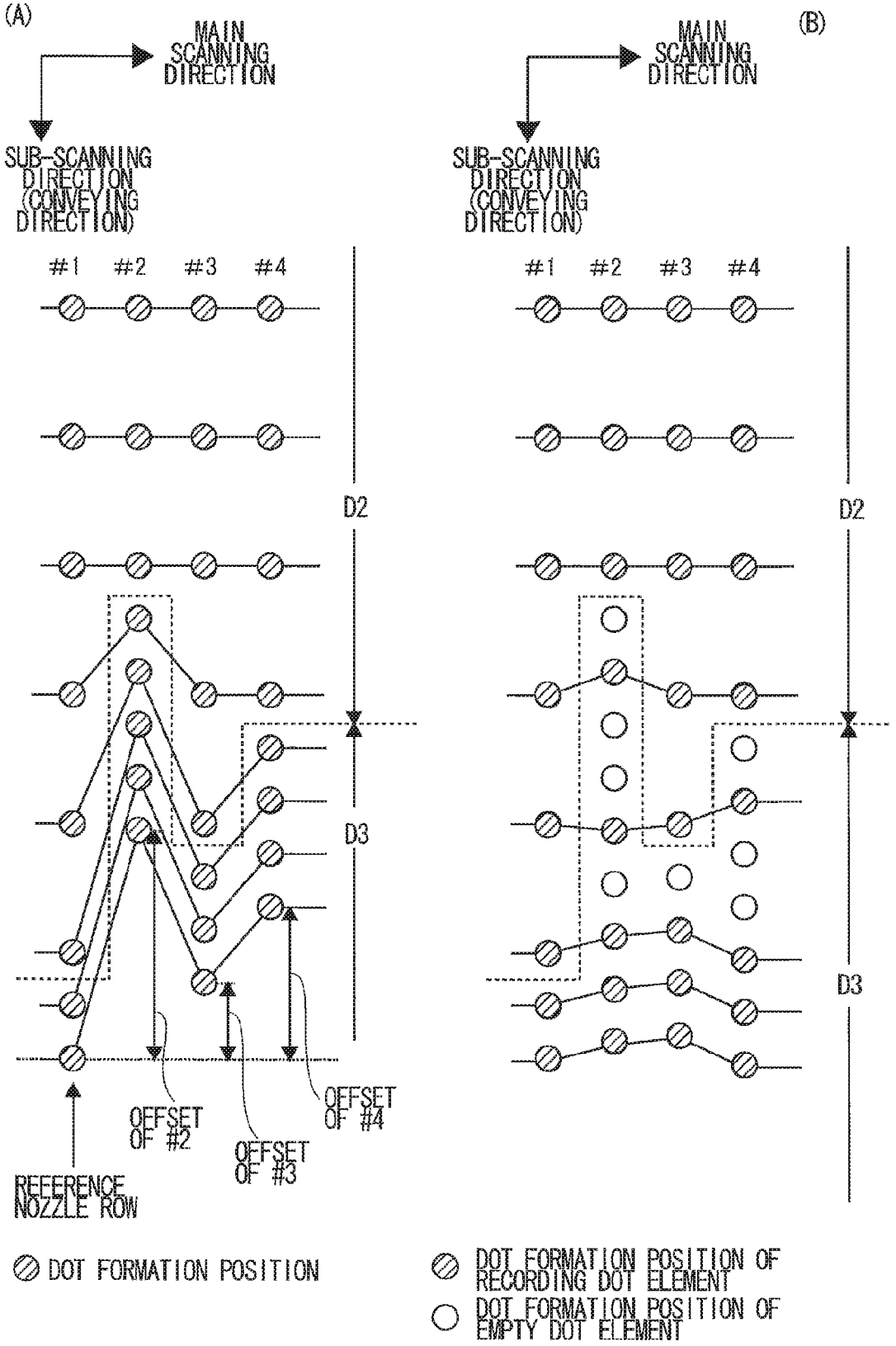
FIG. 10 is an explanatory diagram showing (a) dot formation positions when the correction is not executed and (b) dot formation positions when the correction is executed in a modification.

Next, details of correction processing according to a modification of the embodiment are described with referring to FIG. 10. In the modification, the correction processing corrects positions in the conveying direction of dots corresponding to the dot elements in one raster data of the pre-correction data so that the positions of dots corresponding dot elements of the post-correction raster data are substantially the same position in the conveying direction. The post-correction raster data includes recording dot elements that are included in the post-correction data and have density values of dot elements constituting of the one raster data of the pre-correction data.

Specifically, the correction is executed in the following manner. First, one of thirty-two nozzle arrays 8*a* of the head 1 is set as a reference nozzle array. The most upstream nozzle array 8*a* of the thirty-two nozzle arrays 8*a* in the conveying direction is preferably set as the reference nozzle when the divisional section D3 (second divisional section) is disposed downstream from the divisional sections D1 and D2 (first divisional section) in the conveying direction, as in this embodiment. This is because the dot data row corresponding to each nozzle 8 of the most upstream nozzle array 8*a* includes: the largest number of dot elements corresponding to dots that are formed in the period in which the paper P is conveyed in the divisional sections D1 and D2 among the thirty-two nozzle arrays 8*a*; and the smallest number of to-be-corrected dot elements among the thirty-two nozzle arrays 8*a*. If the second divisional section is disposed upstream from the first divisional section in the conveying direction unlike the above-described embodiment, the most downstream nozzle array 8*a* in the conveying direction among the thirty-two nozzle arrays 8*a* is preferably set to the reference nozzle array. Hereinafter, the following description is based on the assumption that the reference nozzle array is the nozzle array #1.

Subsequently, dot data row corresponding to each nozzle 8 belonging to the reference nozzle array #1 among the plurality of dot data rows of the pre-correction data is set as the reference dot data row, and dot data rows corresponding to the nozzles 8 belonging to the remaining nozzle arrays #2 to #32 are set as dot data rows to be corrected (to-be-corrected dot data rows). Each of dot elements corresponding to a dot formed on the paper P during the period in which the paper P is conveyed in the divisional section D3 is selected as the to-be-corrected dot element from among the dot elements included in the to-be-corrected dot data rows.

As illustrated in FIG. 10(A), the RIPCPU 56 determines, as a correction amount for each to-be-corrected dot element, a deviation amount of positions on the paper P between: a formation position of a dot corresponding to the each to-be-corrected dot element; and a formation position of a dot corresponding to a dot element whose order in the reference dot data row is the same as the order of the each to-be-corrected dot element in the corresponding dot data row. The correction amount for each to-be-corrected dot element is stored in the RAM 54 in advance.

Hereinafter, the post-correction data can be generated in a similar manner to the above-described embodiment. Specifically, the post-correction data can be generated by:

obtaining the number of dot elements for correction corresponding to the correction amount for each to-be-corrected dot element; and by setting a density value set for the each to-be-corrected dot element of the pre-correction data as a density value of a corresponding dot element whose order is behind the order of the each to-be-corrected dot element by the number of dot elements for correction, wherein the corresponding dot element in the post-correction data is positioned downstream in the array direction from a position of the each dot element in the pre-correction data by the number of dot elements for correction. As a result, it is possible to correct the formation positions of recording dots corresponding to recording dot elements that have density values for the to-be-corrected dot elements of the same raster data in the pre-correction data, so that the formation positions of the recording dot elements are close to each other, as illustrated in FIG. 10(B).

The disclosure is not limited to the embodiment and modification described above, and may be variously modified. For example, each of the first conveying unit 21 and the second conveying unit 22 includes the pair of conveying rollers in the above-described embodiment, however, each of the first conveying unit 21 and the second conveying unit 22 may include a conveyance belt wound around a driving roller and a driven roller.

Figure 11:
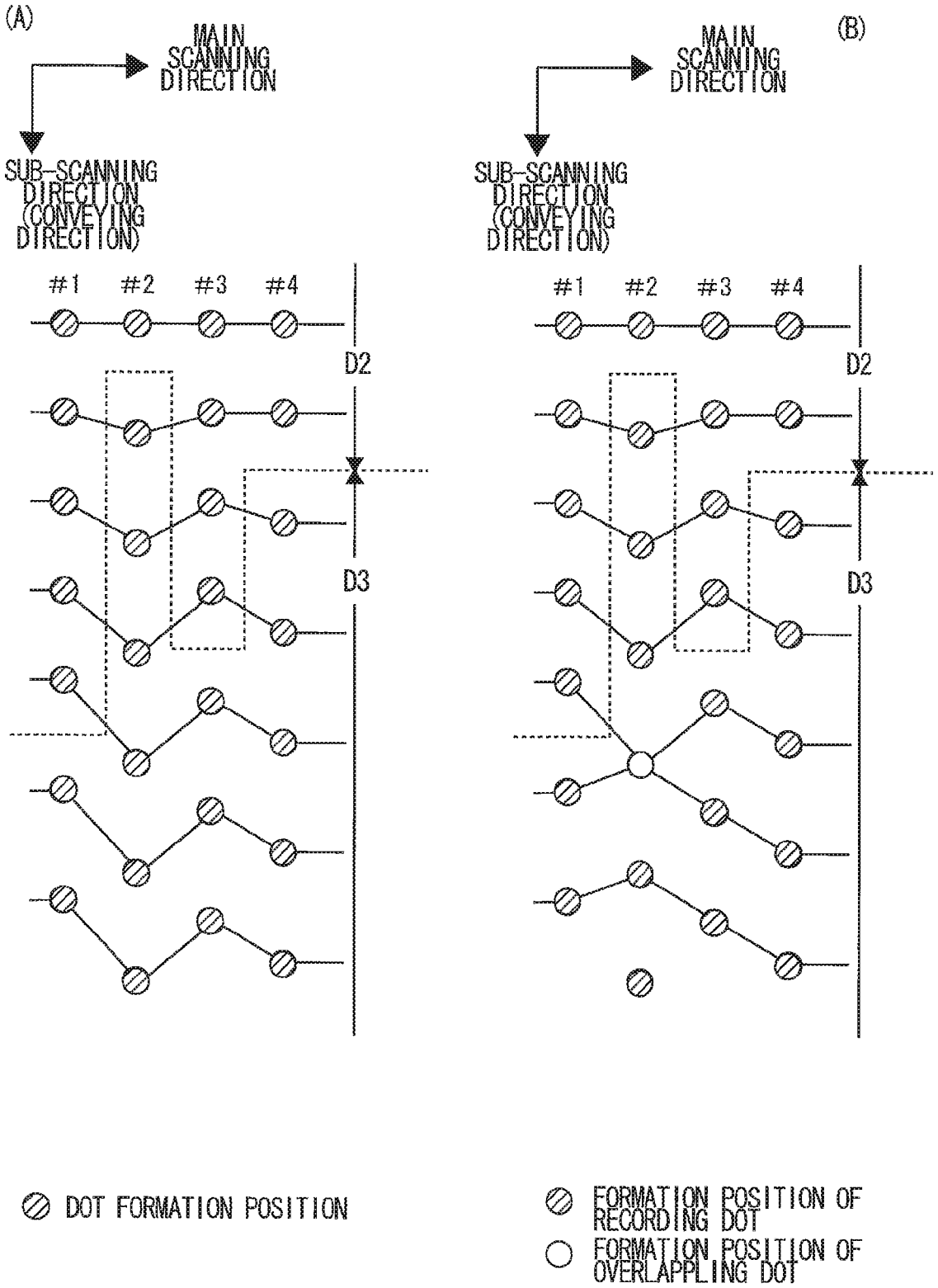
FIG. 11 is an explanatory diagram showing (a) dot formation positions when the correction is not executed and (b) dot formation positions when the correction is executed in a variation.

In the embodiment described above, the first conveyance speed V1 is faster than the second conveyance speed V2. However, the first conveyance speed V1 may be slower than the second conveyance speed V2. In this variation, as illustrated in FIG. 11(A), a dot pitch in the conveying direction of dots formed on the paper P in the period in which the paper P is conveyed in the divisional section D3 is longer than a dot pitch of dots formed in the period in which the paper P is conveyed in the divisional sections D1 and D2. Therefore, an actual formation position of a dot formed on the paper P being conveyed in the divisional section D3 is shifted from an ideal formation position thereof downstream in the conveying direction. Accordingly, the correction processing according to this variation sets a density value that is set for each to-be-corrected dot element in the pre-correction data, as a density value of a dot element of the post-correction data whose number indicative of an order is smaller than that of the to-be-corrected dot element in the pre-correction data by the number of dot elements for correction. Through the generation of the post-correction data based on the pre-correction data described above, a formation position of a recording dot corresponding to the post-correction raster data can be put close to an ideal formation position of a dot corresponding to a to-be-corrected dot element of the pre-correction data, as illustrated in FIG. 11(B). In this case, the same dot element in the post-correction data may set as the destination for which a density value of each of two adjacent dot elements in each dot data row in the pre-correction data is set. The same dot element hereinafter will be referred to as "dot element corresponding to overlapping dots" as shown in FIG. 11(B). If there is the dot element corresponding to overlapping dots in the post-correction data, any one of the density values for the two adjacent dot elements in the pre-correction data may be set as the density value for the dot element corresponding to the overlapping dots.

In the embodiment described above, the first divisional section (corresponding to the divisional sections D1 and D2) is positioned upstream from the second divisional section (divisional section D3) in the conveying direction. However, the first divisional section may be positioned downstream from the second divisional section in the conveying direction.

In the embodiment described above, the correction processing is performed by the RIPCPU 56, but may be performed by the image processing circuit 60. In this case, the image processing circuit 60 may be configured to: receive, from the RIPCPU 56, information indicating both size and coordinates of a region corresponding to a line image extending in the main scanning direction; and correct density values set for dot elements of the multi-value data on the basis of the received information. Further, the image processing circuit 60 may be configured to perform the correction processing on four-value data on which the error diffusion processing has been performed.

In the embodiment described above, a provisional to-be-corrected dot element is changed to a not-to-be-corrected dot element if a condition (1) that the provisional to-be-corrected dot element corresponds to a dot formed on the paper P within the period in which the paper P is conveyed in the divisional section D3 and a condition (2) that the provisional to-be-corrected dot element is not related to recording of the line image extending in the main scanning direction are met. However, the provisional to-be-corrected dot element meeting the conditions (1) and (2) may not be changed. That is, all provisional to-be-corrected dot elements to be formed on the paper P in the period in which the paper P is conveyed in the divisional section D3 may be corrected.

Further, the correction amount for each to-be-corrected dot is stored in the RAM 54 in the embodiment described above. However, the number of dot elements for correction set for each to-be-corrected dot may be pre-stored in the RAM 54.

When the conveyance amount of the paper P per unit time within the period in which the paper P is conveyed in the divisional section D1 is different from that within the period in which the paper P is conveyed in the divisional section D2, a dot element corresponding to each dot to be formed in the period in which the paper P is conveyed in the divisional section D2 may be set as a to-be-corrected dot element. In this case, the divisional section D2 corresponds to the second divisional section. Further, the conveyance section may be divided into four or more divisional sections those conveyance amounts of the paper P per unit time are different from one another.

Further, the head control circuit 76 may be configured to adjust ejection timing of ink droplets such that an actual formation position of a recording dot is adjusted to an ideal formation position of the recording dot. In this case, a deviation amount of the recording dot between the actual formation position and the ideal formation position becomes less than one dot through the correction processing. Thus, a circuit structure of the head control circuit 76 can be simplified compared to a case in which the formation position of the recording dot is adjusted to approach the ideal formation position only by the head control circuit 76 without performing correction processing.

The disclosure is applicable to a liquid ejection apparatus that ejects a liquid other than ink. Further, the liquid ejection apparatus is not restricted to a printer, and is applicable to a facsimile machine or a copy machine.

While the description has been made in detail with reference to specific embodiment thereof, it would be apparent to those skilled in the art that various changes and modifications may be made therein.

What is claimed is:

1. A liquid ejection apparatus comprising:

a conveying mechanism configured to convey a recording medium in a conveying direction;

a liquid ejection head having an ejection surface on which a plurality of nozzle arrays is arranged in the conveying direction, each of the plurality of nozzle arrays having a plurality of nozzles arranged in a direction perpendicular to the conveying direction, each of the plurality of nozzles for ejecting a liquid droplet on the recording medium conveyed by the conveying mechanism, a conveyance section being defined between a position at which a leading end of the recording medium reaches an ejection region and a position at which a trailing end of the recording medium has passed through the ejection region, the ejection region being a region in which at least part of the recording medium faces at least one nozzle on the ejection surface, the conveyance section being divided into a first divisional section in which the recording medium is conveyed a first conveyance amount per unit time and a second divisional section in which the recording medium is conveyed a second conveyance amount per unit time; and a controller configured to:

correct image data to generate corrected image data, the image data including a plurality of dot data rows, each of the plurality of dot data rows having a plurality of dot elements that is arranged in a data array direction, the plurality of dot elements corresponding to a plurality of dots to be formed and arranged in the conveying direction on the recording medium, the plurality of dot elements and the plurality of dots having a one-to-one correspondence, an order of each of the dot elements in the data array direction being the same as an order of a corresponding one dot of the plurality of dots to be formed on the recording medium in the conveying direction, a density value being set for each of the plurality of dot elements; and control the liquid ejection head to record dots on the recording medium on a basis of the corrected image data such that liquid droplets are ejected from nozzles of the liquid ejection head on an assumption that the recording medium is conveyed a predetermined conveyance amount per unit time during a period of time in which the recording medium is conveyed within a conveyance section, the predetermined conveyance amount being equal to the first conveyance amount, wherein the controller is configured to generate the corrected image data by:

setting, as a to-be-corrected dot element, a dot element corresponding to a dot to be formed on the recording medium during a period of time in which the recording medium is conveyed in the second divisional section, from among the plurality of dot elements included in each of the plurality of dot data rows;

acquiring a correction amount for the to-be-corrected dot element, the correction amount being based on an offset in the conveying direction between: a formation position at which a dot corresponding to the to-be-corrected dot element is to be formed on the recording medium during the period of time in which the recording medium is conveyed the second conveyance amount per unit time; and a formation position at which a dot corresponding to the to-be-corrected dot element is to be formed on the recording medium during the period of time in which the recording medium is conveyed a reference conveyance amount per unit time; and executing correction on the to-be-corrected dot element by setting the density value that is set for the to-be-corrected dot element as a density value for a corresponding one dot element in the corrected image data, an order in the data array direction of the corresponding one dot element of the corrected image data being shifted from an order in the data array direction of the to-be-corrected dot element of the image data by a number of dot elements corresponding to the correction amount.

2. The liquid ejection apparatus according to claim 1, wherein the reference conveyance amount is greater than the second conveyance amount.

3. The liquid ejection apparatus according to claim 1, wherein the controller is further configured to determine whether or not the image data includes a dot element group having the to-be-corrected dot element and a not-to-be-corrected dot element, the not-to-be-corrected dot element being a dot element corresponding to a dot to be formed on the recording medium during a period of time in which the recording medium is conveyed within the first divisional section, the dot element group being a group of dot elements each having a density value corresponding to an ejection amount of the liquid greater than zero, the dot element group being surrounded by dot elements each having a density value corresponding to the ejection amount of the liquid being zero, wherein the correction is executed on each of the dot elements included in the dot element group when the image data includes the dot element group having the to-be-corrected dot element and the not-to-be-corrected dot element.

4. The liquid ejection apparatus according to claim 1, wherein the controller is further configured to determine whether or not the image data includes a dot element group having the to-be-corrected dot element and a not-to-be-corrected dot element, the not-to-be-corrected dot element being a dot element corresponding to a dot to be formed on the recording medium during a period of time in which the recording medium is conveyed within the first divisional section, the dot element group being a group of dot elements each having a density value corresponding to an ejection amount of the liquid greater than zero, the dot element group being surrounded by dot elements each having a density value corresponding to the ejection amount of the liquid being zero, wherein the correction is not executed on any dot elements included in the dot element group when the image data includes the dot element group having the to-be-corrected dot element and the not-to-be-corrected dot element.

5. The liquid ejection apparatus according to claim 1, wherein the controller is further configured to:

determine whether or not the to-be-corrected dot element is a line image dot element corresponding to a dot included in a line image to be formed on the recording medium, the line image indicative of a line extending in the direction perpendicular to the conveying direction, wherein the correction is executed on the to-be-corrected dot element if the to-be-corrected dot element is determined to be the line image dot element, and wherein the correction is not executed on the to-be-corrected dot element if the to-be-corrected dot element is determined not to be the line image dot element.

6. The liquid ejection apparatus according to claim 1, wherein the density value of each dot element included in the image data is expressed by M gradations, M being an integer greater than or equal to 3, and wherein the controller is further configured to:

execute, when or before the correction is executed on the to-be-corrected dot element, a first edge processing on the to-be-corrected dot element if the to-be-corrected dot element corresponds to an edge portion of an image based on the image data, the first edge processing decreasing the density value for the to-be-corrected dot element, generate N-level data based on the corrected image data, the N-level data including a dot element that corresponds to each dot element included in the corrected image data and has a density value expressed by N gradations, N being an integer greater than or equal to 2 and smaller than M;

execute a second edge processing on the N-level data to decrease a density value of a dot element that is included in the N-level data and corresponds to an edge portion of an image based on the N-level data; and control the liquid ejection head to record dots on the recording medium on a basis of the density value of each dot element included in the N-level data on which the second edge processing has been executed.

7. The liquid ejection apparatus according to claim 1, wherein the conveying mechanism includes:

a first conveying unit configured to convey the recording medium; and a second conveying unit configured to convey the recording medium received from the first conveying unit a conveyance amount per unit time different from a conveyance amount of the recording medium per unit time of the first conveying unit, wherein the first divisional section is a part of the conveyance section in which at least a conveying force of one of the first conveying unit and the second conveying unit is applied to the recording medium, the one of the first conveying unit and the second conveying unit being the first conveying unit when the conveyance amount of the recording medium per unit time of the first conveying unit is larger than the conveyance amount of the recording medium per unit time of the second conveying unit, the one of the first conveying unit and the second conveying unit being the second conveying unit when the conveyance amount of the recording medium per unit time of the second conveying unit is larger than the conveyance amount of the recording medium per unit time of the first conveying unit, and wherein the second divisional section is a part of the conveyance section in which the conveying force of the one of the first conveying unit and the second conveying unit is not applied to the recording medium and a conveying force of another of the first conveying unit and the second conveying unit is applied to the recording medium.

* * * * *